US010472754B2

(12) United States Patent
Sakuma et al.

(10) Patent No.: US 10,472,754 B2
(45) Date of Patent: Nov. 12, 2019

(54) SEWING MACHINE THREADING DEVICE

(71) Applicant: SUZUKI MANUFACTURING, LTD., Yamagata (JP)

(72) Inventors: Tohru Sakuma, Yamagata (JP); Mitsuharu Suzuki, Yamagata (JP); Shigenori Kudo, Yamagata (JP); Mitsuru Satou, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 15/564,312

(22) PCT Filed: Jun. 30, 2016

(86) PCT No.: PCT/JP2016/069416
§ 371 (c)(1),
(2) Date: Oct. 4, 2017

(87) PCT Pub. No.: WO2017/138163
PCT Pub. Date: Aug. 17, 2017

(65) Prior Publication Data

US 2019/0048503 A1 Feb. 14, 2019

(30) Foreign Application Priority Data

Feb. 10, 2016 (JP) ..... 2016-023688

(51) Int. Cl.
*D05B 87/00* (2006.01)

(52) U.S. Cl.
CPC ..... *D05B 87/00* (2013.01); *D05D 2207/04* (2013.01)

(58) Field of Classification Search
CPC ..... D05B 87/00; D05B 87/02; D05B 87/04; D05D 2207/00; D05D 2207/02; D05D 2207/04
See application file for complete search history.

(56) References Cited

U.S. PATENT DOCUMENTS 2,413,014 A * 12/1946 Wall ..... D05B 87/00 112/225
3,289,902 A * 12/1966 Fritts ..... D05B 87/00 112/225

(Continued)

FOREIGN PATENT DOCUMENTS

JP 04336095 A * 11/1992
JP H06154461 A 6/1994

(Continued)

OTHER PUBLICATIONS

International Search Report listed in Application PCT/JP2016/069416 dated Jun. 30, 2016.

*Primary Examiner* — Ismael Izaguirre
(74) *Attorney, Agent, or Firm* — Bacon & Thomas, PLLC

(57) ABSTRACT

A sewing machine threading device includes: hermetic lips capable of making hermetic contact with a peripheral band-ring-shaped region of needles surrounding thread exits of needle eye, and which further includes a peripheral band-ring-shaped pad which surrounds suction port holes which draw in air from the thread exits of the needle eyes; a needle thread suction conduit pipe connected to the suction port holes; a position switching mechanism which moves the hermetic lips to a threading position such that the hermetic lips are in contact with the needle with the suction port holes being aligned with the thread exits, and, when forming a stitch, retracts the hermetic lips from the needle and moves said hermetic lips to a standby position; and a pump which takes in one end of the thread to be inserted into thread entrances of the needle eyes.

14 Claims, 22 Drawing Sheets

(56) References Cited

U.S. PATENT DOCUMENTS

| | | | | | |
|---|---|---|---|---|---|
| 3,486,472 | A | * | 12/1969 | Kaplan | D05B 87/00 112/225 |
| 3,540,392 | A | * | 11/1970 | Kaplan | D05B 87/00 112/225 |
| 3,599,587 | A | * | 8/1971 | Greulich | D05B 87/00 112/225 |
| 4,075,959 | A | * | 2/1978 | Zocher | D05B 87/00 112/225 |
| 4,198,915 | A | * | 4/1980 | Peterson | D05B 87/00 112/225 |
| 5,327,841 | A | * | 7/1994 | Sakuma | D05B 87/00 112/162 |
| 6,067,920 | A | * | 5/2000 | Uemoto | D05B 87/00 112/225 |
| 2012/0210922 | A1 | * | 8/2012 | Sakuma | D05B 87/00 112/199 |

FOREIGN PATENT DOCUMENTS

| | | | |
|---|---|---|---|
| JP | H1076094 | A | 3/1998 |
| JP | 11267390 | * | 10/1999 |
| JP | 2007105283 | A | 4/2007 |
| JP | 2008036341 | A | 2/2008 |
| JP | 2011062501 | A | 3/2011 |

* cited by examiner

SEWING MACHINE THREADING DEVICE

FIELD OF THE ART

The present invention relates to a needle threading device of sewing machine, and particularly relates to the pneumatic needle threading device of sewing machine for threading a needle thread by using gas carrying to a sewing machine needle of such as a lock stitch sewing machine, a serger, a double chain stitch sewing machine, or a cover stitch sewing machine.

BACKGROUND OF THE ART

Conventionally, in the lock stitch sewing machine, the serger, the double chain stitch sewing machine, or the cover stitch sewing machine, etc., generally, mechanical needle threading tools and devices for threading a needle thread to a needle are widely used. Besides, the pneumatic needle threading devices which use the gas carrying with exhaust form for threading the needle thread to the needle are proposed.

On the other hand, the pneumatic needle threading devices which use the gas carrying with suction form for threading the needle thread to the needle are proposed (cf: Patent document Nos. 1-6).

PRIOR ART DOCUMENT

Patent Document

[Patent document No. 1] U.S. Pat. No. 2,413,014 B
[Patent document No. 2] JP 48-9609 B (=JP 00706285 B)
[Patent document No. 3] JP 55-54993 A
[Patent document No. 4] U.S. Pat. No. 3,599,587 B
[Patent document No. 5] JP 55-5079 U (=U.S. Pat. No. 4,198,915 B)
[Patent document No. 6] U.S. Pat. No. 5,345,888 B

SUMMARY OF THE INVENTION

Problem to be Solved by the Invention

The pneumatic needle threading devices which use the gas carrying with the suction form which are disclosed in the patent documents 1-6 have possibility Which can perform the needle threading to a needle eye of the sewing machine needle with relatively stable state compared with the pneumatic needle threading which uses the gas carrying with the exhaust form.

However, in the pneumatic needle threading devices which use the gas carrying with the suction form which are disclosed in the patent documents 1-6, practically, a peripheral part surrounding the needle eye of the sewing machine needle which should suck in the needle threading apparatus is not connected closely with circumference of the needle eye of the sewing machine needle which Should suck. From this, the needle threading apparatus sucks not only from the needle eye of the sewing machine needle which should suck intrinsically but also from an interface in which close connection between the peripheral part surrounding the needle eye of the sewing machine needle which should suck in the needle threading apparatus and the circumference of the needle eye of the sewing machine needle which should suck is incomplete. Thereby, the suction amount of the pump which is driven by a sewing machine motor which is used widely cannot give the suction power which is sufficient for threading the needle thread from the needle eye of the sewing machine needle which should suck essentially.

For this reason, the pneumatic needle threading device by using the gas carrying with the suction form is not implemented concretely in present and there are problems that it is impossible to access or purchase in the market.

Therefore, the present invention was conducted to solve these disadvantages. The object of the present invention is to provide the pneumatic needle threading device of sewing machine for threading the needle thread with the suction form which sucks from only needle eye of the sewing machine needle by using gas carrying to the sewing machine needle of such as the lock stitch sewing machine, the serger, the double chain stitch sewing machine, or the cover stitch sewing machine.

Besides, the object of the present invention is to provide the pneumatic needle threading device of sewing machine for threading the needle thread with the suction form which can suck from only needle eye of the sewing machine needle by using gap carrying to the sewing machine needle, reduce fluid resistance and give sufficient suction power with the suction amount of the pump which is driven by a sewing machine motor which is used widely.

Further, the object of the present invention s to provide also the pneumatic looper threading device of sewing machine for threading the looper thread with the exhaust form which exhausts to the looper hole of the sewing machine looper by using gas carrying with the pneumatic needle threading device of sewing machine for threading the needle thread with the suction form which sucks from only needle eye of the sewing machine needle by using gas carrying to the above-described sewing machine needle.

Further, the object of the present invention is to provide the pneumatic needle threading device of sewing machine which performs the pneumatic needle threading with the suction form from the needle eye of the sewing machine needle and the pneumatic looper threading with the exhaust form to the looper hole of the sewing machine looper by using the suction and the exhaust to the gas carrying by only one pump Which is driven by the sewing machine motor.

Means for Solving the Problems

In order to achieve the above-mentioned objects, in a pneumatic threading device of sewing machine which has a stitch forming apparatus which includes a needle of the sewing machine and a loop capturing apparatus which forms stitches by entangling a needle thread which is threaded to a needle eye of the needle by cooperating with the needle and threads to the needle eye of the needle pneumatically, a threading device of sewing machine of the present invention has a hermetic lip which is hermetically touchable to a peripheral band-ring-shaped region of the needle which surrounds a thread exit of the needle eye of the needle and has a corresponding peripheral band-ring-shaped pad which surrounds an suction pore hole which sucks from the thread exit of the needle eye of the needle, a needle thread suction conduit pipe which is connected to the suction port hole of the hermetic lip, a position switching mechanism which moves the hermetic lip to a threading position so that the suction port hole is aligned to the thread exit of the needle eye of the needle and is touched to the needle at the time of the needle threading and moves to a standby position by retreating the hermetic lip from the needle at the time of the stitch forming, and a pump that the needle thread suction conduit pipe is connected to an suction port and performs the needle threading to the needle eye of the needle by sucking one end of the needle thread which is inserted to a thread entrance of the needle eye of the needle to the suction port via the suction port hole from the thread exit of the needle eye of the needle through the needle thread suction conduit pipe at the time of the needle threading.

the needle has a concave part for passing a loop-taker point of the loop capturing apparatus in an upper part of the needle eye and a peripheral band-ring-shaped region of the needle has an upper flat shape band region part which intersects an intermediate part of the concave part and extends horizontally, a lower semicircular band region part which intersects a lower part of the needle eye and extends horizontally and two lateral band region parts which connect the upper flat shape band region part and the lower semicircular band region part and extend vertically and in a circumferential direction, and corresponding to this, the peripheral band-ring-shaped pad of the hermetic lip has an upper flat shape band segment which extends horizontally, a lower semicircular band segment which extends horizontally and two lateral band segments which connect the upper flat shape band segment and the lower semicircular band segment and extend vertically and in a circumferential direction.

In the threading device of sewing machine of the present invention, the hermetic lip is formed by one material which is selected from flexible rubbers, plastics and corks.

In the threading device of sewing machine of the present invention, the hermetic lip is formed by one material which is selected from elastic rubbers, plastics and corks which do not impair the flexibility.

In the threading device of sewing machine of the present invention, a separator which has a thread stopping wall that the needle thread which is carried by the suction from the needle thread suction conduit pipe collides and a space which prevents that flow velocity of air which collides against the thread stopping wall is lower than flow velocity which is carried by the suction toward the pump and the needle thread which is stopped by the collision against the thread stopping wall is sucked toward the pump is provided between the needle thread suction conduit pipe and the pump.

In the threading device of sewing machine of the present invention, the position switching mechanism has an operation part which forms a preparatory position which becomes a preparatory state of the needle threading by primary manual operation and holds the preparatory position and a needle threading positioning part which is moved with the operation part and forms a needle threading position which becomes a needle threading state of the needle threading from the preparatory position with predetermined needle threading timing depending on secondary manual operation.

In the threading device of sewing machine of the present invention, the operation part has a manual lever which is operated manually and a transmission part which is connected to the manual lever and holds the preparatory position by a hook, and the needle threading positioning part has a control part which is movable through the transmission part, and is repelled elastically by a spring, and forms the needle threading position which becomes the needle threading state of the needle threading with predetermined needle threading timing depending on the secondary manual operation, and attaches the hermetic lip, end moves the hermetic lip so that the suction port hole is aligned to the thread exit of the needle eye of the needle and touches the needle.

In the threading device of sewing machine of the present invention, the needle threading positioning part has a control pin, a control plate which regulates a movement of the control pin and a positioning pin which pierces the control plate and touches a disc which has a notched part which is driven by synchronizing to the needle and shifts to an axial direction when fitting into the notched pert depending on the secondary manual operation and swings the control plate and moves the hermetic lip by the control part so that the suction port hole is aligned to the thread exit of the needle eye of the needle and touches the needle.

In the threading device of sewing machine of the present invention, the needle is composed with multiple needles, and the multiple needles are divided into at least two groups, and a flow channel selection apparatus which selects each needle of the two groups and connects to the suction port of the pump is provided.

In the threading device of sewing machine of the present invention, the stitch forming apparatus which forms the stitches by entangling the needle thread and the looper thread which are threaded respectively to the needle eye of the needle and the looper hole of the looper by cooperating with the looper as the loop capturing apparatus is provided, and a looper thread introduction entrance that an exhaust port of the pump connected, a looper thread guide conduit pipe which is connected to the looper thread introduction entrance and carries one end of the looper thread which is inserted to this looper thread introduction entrance by compressed air from the exhaust port, a looper thread connecting conduit pipe which is fitted into the looper thread guide conduit pipe in the nested state and touches the looper hole entrance of the looper at the time of the looper threading, and a conduit pipe connecting mechanism which makes the looper thread connecting conduit pipe touch the looper hole entrance of the looper and performs the looper threading to the looper hole of the looper through the looper thread connecting conduit pipe via the looper thread guide conduit pipe from the looper thread introduction entrance about one end of the looper thread which is inserted to the looper thread introduction entrance at the time of the looper threading and separates the looper thread connecting conduit pipe from the looper hole entrance of the looper at the time of the stitch forming are provided.

In the threading device of sewing machine of the present invention, the conduit pipe connecting mechanism has an operation part which is attached to a sewing machine and forms a preparatory position which becomes preparatory state of the over threading by the primary manual operation and holds the preparatory position and a looper threading positioning part which forms a looper threading position which becomes looper threading state of the looper threading with predetermined looper threading timing depending on the secondary manual operation from the preparatory position.

In the threading device of sewing machine of the present invention, the looper threading positioning part has a positioning pin which is driven by synchronizing to the looper, touches a disc which has a notched part, shifts to an axial direction when fitting into the notched part depending on the secondary manual operation, moves the control plate, and moves the looper thread connecting conduit pipe so as to align and touch to the looper hole entrance of the looper.

In the threading device of sewing machine of the present invention, between the needle thread suction conduit pipe and the looper thread connecting conduit pipes and between the suction port and the exhaust port of the pump, respectively, a flow channel switching apparatus that the needle thread suction conduit pipe is communicated with the suction port, the looper thread connecting conduit pipe is communicated with an atmosphere port and switching is performed at the time of the needle threading and the exhaust port is communicated with the looper thread connecting conduit pipe, the suction port is communicated with an atmosphere port and switching is performed at the time of the looper threading is provided.

In the threading device of sewing machine of the present invention, the flow channel switching apparatus has a flow channel switching valve which interlocks with the primary manual operation and the one of the suction port and the exhaust port is communicated with one of the needle thread suction conduit pipe and the looper thread connecting conduit pipe and the other of the suction port and the exhaust port is communicated with an atmosphere port, and the other of the suction port and the exhaust port is communicated with the other of the needle thread suction conduit pipe and the looper thread connecting conduit pipe and one of suction port and the exhaust port is communicated with an atmosphere port, and switching is performed.

In the threading device of sewing machine of the present invention, in a pneumatic threading device of sewing machine which has a stitch forming apparatus which includes a needle of the sewing machine and a loop capturing apparatus which forms locked stitches by entangling a needle thread which is threaded to a needle eye of the needle by cooperating with the needle end threads to the needle eye of the needle pneumatically, a hermetic lip which is hermetically touchable to a semicircular cage part of the needle which includes a thread exit of the needle eye of the needle and has a corresponding semicircular edge part which includes a suction port hole which sucks from the needle eye of the needle, a needle thread suction conduit pipe which connected to the suction port hole of the hermetic lip, a position switching mechanism which makes the hermetic lip touch the needle so that the suction port hole is aligned to the thread exit of the needle eye of the needle at the time of the needle threading and moves to a standby position by retreating the hermetic lip from the needle at the time of the stitch forming, a pump that the needle thread suction conduit pipe is connected to a suction port and performs the needle threading to the needle eye of the needle by sucking one end of the needle thread which is inserted to a thread entrance of the needle eye of the needle to the suction port via the suction port hole from the thread exit of the needle eye of the needle through the needle thread suction conduit pipe at the time of the needle threading, a stitch forming apparatus which forms chain stitches by entangling the needle thread and the looper thread which are threaded respectively to the needle eye of the needle and the looper hole of the looper by cooperating with the looper as the loop capturing apparatus, a loaner thread introduction entrance that an exhaust port of the pump is connected, a looper thread guide conduit pipe which is connected to the looper thread introduction entrance and carries one end of the looper thread which is inserted to the looper thread introduction entrance by compressed air from the exhaust port, a looper thread connecting conduit pipe which is fitted into the looper thread guide conduit pipe in the nested state and touches the looper hole entrance of the looper at the time of the looper threading, and a conduit pipe connecting mechanism which makes the looper thread connecting conduit pipe touch the looper bole entrance of the looper and performs the looper threading to the looper hole of the looper through the looper thread connecting conduit pipe via the looper thread guide conduit pipe from the looper thread introduction entrance about one end of the looper thread which is Inserted to the looper thread introduction entrance at the time of the looper threading and separates the looper thread connecting conduit pipe from the looper hole entrance of the looper at the time of the stitch forming are provided.

Effect of the Invention

According to the threading device of sewing machine of the present invention, the needle thread can be threaded pneumatically with the suction form which sucks from only the needle eye of the sewing machine needle by using gas carrying to the sewing machine needle of such as the lock stitch sewing machine, the serger, the double chain stitch sewing machine, or the cover stitch sewing machine.

Besides, according to the threading device of sewing machine of the present invention, the needle thread can be threaded pneumatically with the suction form which can suck from only the needle eye of the sewing machine needle by using the gas carrying to the sewing machine needle, reduce the fluid resistance and give the sufficient suction power with the suction amount of the pump which is driven by the sewing machine motor which a used widely.

Besides, according to the threading device of sewing machine of the present invention, the pneumatic needle threading of the sewing machine for threading the needle thread with the suction form which sucks from only the needle eye of the sewing machine needle by using the gas carrying to the sewing machine needle can be performed and also the looper threading can be performed pneumatically with exhaust form to the looper hole of the sewing machine looper by exhausting by using the gas carrying.

Besides, according to the threading device of sewing machine of the present invention, the pneumatic needle threading can be performed with the suction form from the needle eye of the sewing machine needle and the pneumatic looper threading can be performed with the exhaust form to the looper hole of the sewing machine looper by using the suction and the exhaust to the gas carrying only one pump which is driven by the sewing machine motor.

BRIEF DESCRIPTION OF THE DRAWINGS

FIG. 4 (*b*) A perspective view seeing the needle in the sewing direction in the needle threading device of sewing machine by the present invention.

FIG. 4 (*c*) An enlarged perspective view of a hermetic lip in the needle threading device of sewing machine by the present invention.

FIG. 4 (*d*) A partial cutting perspective view of the needle and the hermetic lip in the needle threading device of sewing machine by the present invention.

FIG. 5 (*b*) An A-A arrow sectional view in FIG. 5 (*a*).

FIG. 5 (*c*) A B-B arrow sectional view in FIG. 5 (*a*).

FIG. 5 (*d*) A C-C arrow sectional view in FIG. 5 (*a*).

FIG. 9 (*b*) An A-A arrow sectional view in FIG. 9 (*a*).

FIG. 10 (*b*) A longitudinal sectional view of the flow channel selection apparatus in the needle threading device of sewing machine by the present invention.

FIG. 12 (*b*) A perspective view for explaining the flow channel switching apparatus at the time of the needle threading in the needle threading device of sewing machine by the present invention.

MODE FOR CARRYING OUT THE INVENTION

Figure 1:
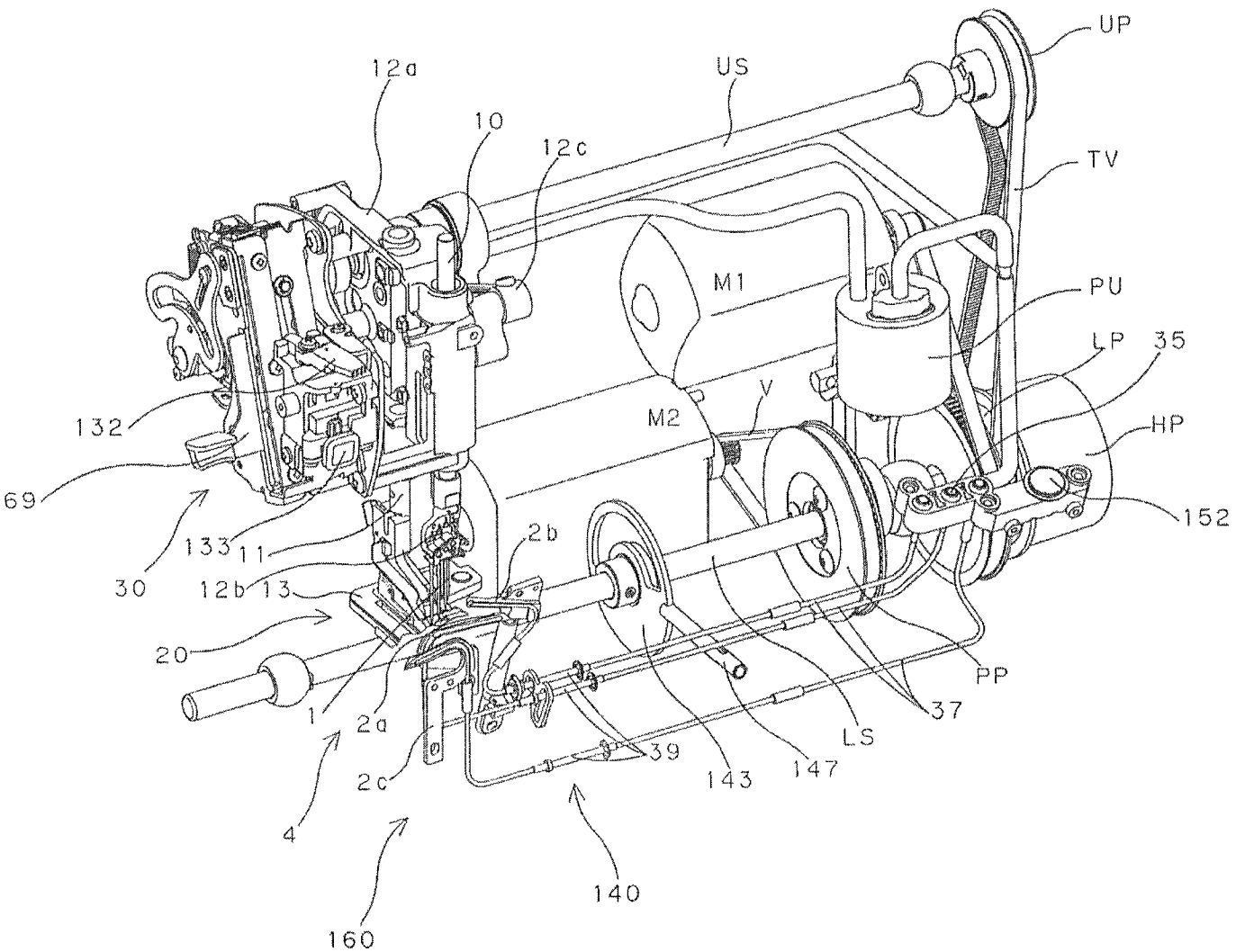
FIG. 1A whole perspective view seeing from a front side of a 5 (five) noodles 8 (eight) threads double chain stitch (cover stitch)-serger (overlook) sewing machine including the needle threading device of sewing machine by the present invention.

Hereinafter, the preferable embodiments that the needle-looper pneumatic threading device of the present invention is applied to a 5 (five) needles 8 (eight) threads double chain stitch (cover stitch)-serger (overlook) sewing machine is explained in detail by referring to the drawings.

As shown in FIG. 1, the double chain stitch (cover stitch)-serger (overlook) sewing machine is composed with a bed, a post and an arm, and a lower shaft LS as a drive shaft and an upper shaft US are extended in parallel and in a horizontal direction respectively. The lower shaft LS is driven rotationally by a sewing machine motor M1. The upper shaft US is driven rotationally by synchronizing to the lower shaft LS by a lower shaft pulley LP, a timing belt TV and an upper shaft pulley UP. Rotation ratio of the lower shaft LS and the upper shaft US is 1:1. A manually rotatable hand pulley HP is connected to the Lower shaft LS at the time of stopping of the sewing machine motor M1.

Figure 2:
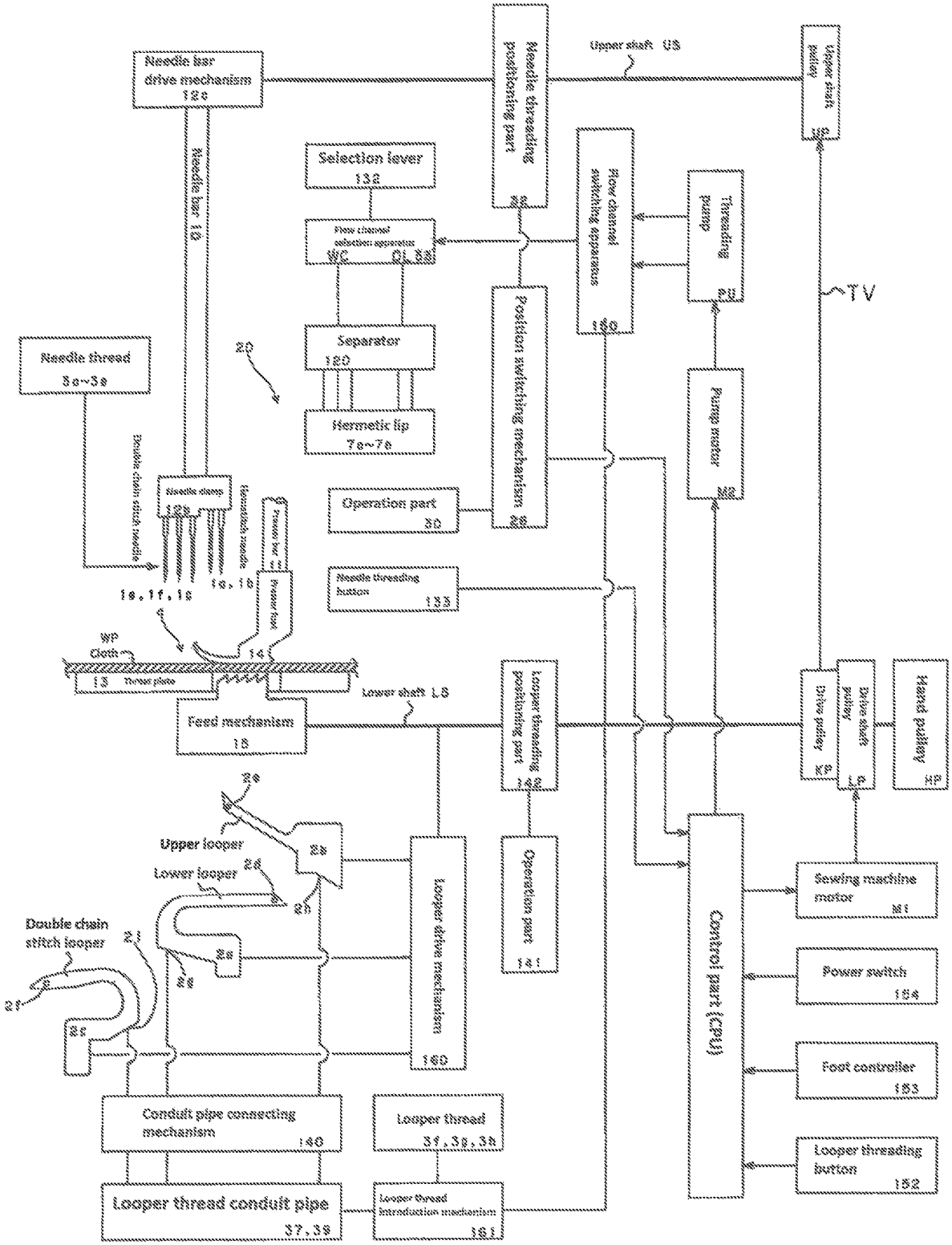
FIG. 2 A block diagram of the 5 (five) needles 8 (eight) threads double chain stitch (cover stitch)-serger (overlook) sewing machine including the needle threading device of sewing machine by the present invention.
Figure 3:
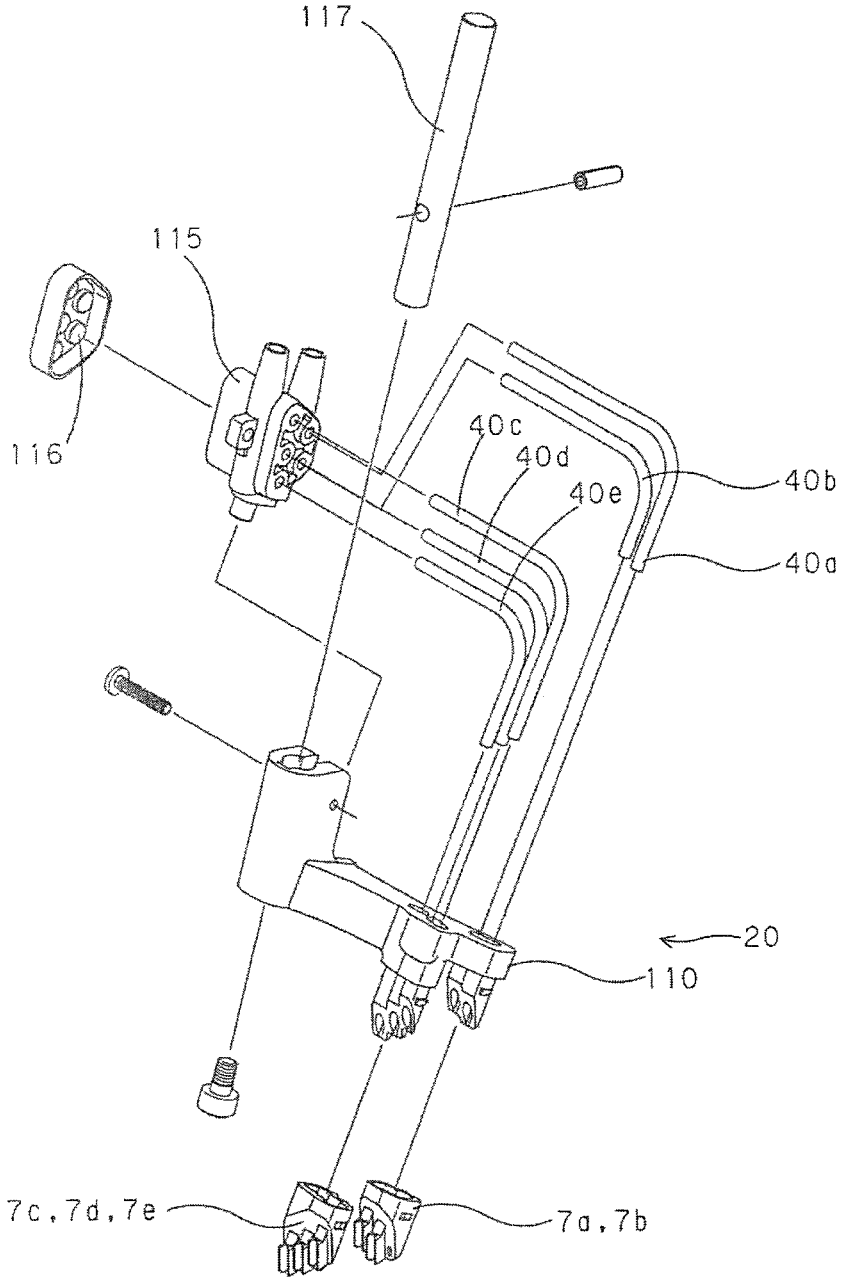
FIG. 3 A partial exploded perspective view of the needle threading device of sewing machine by the present invention.
Figure 4A:
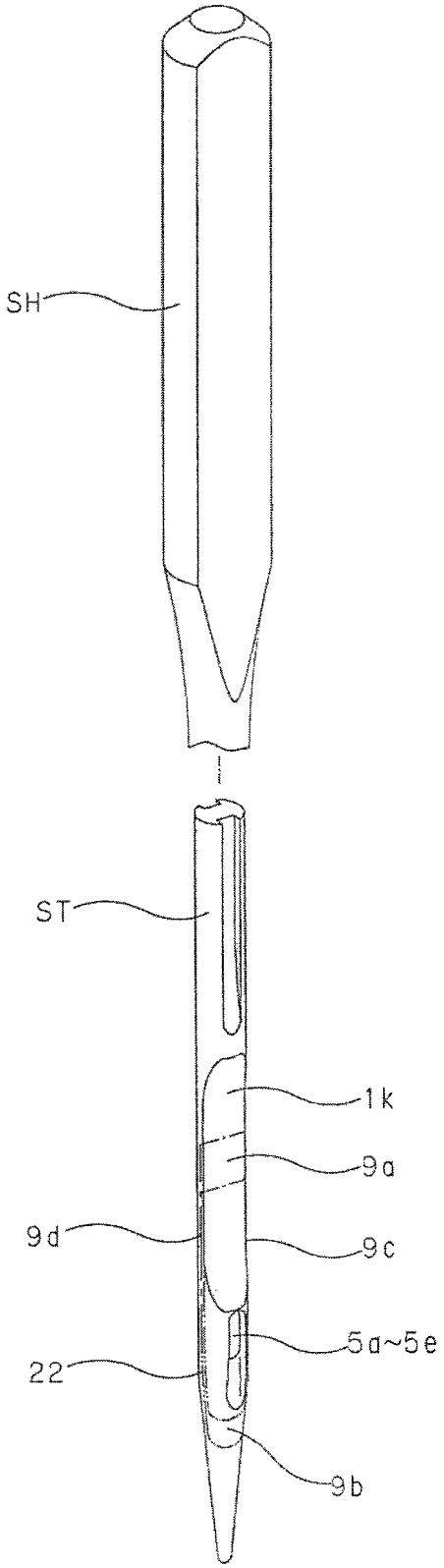
FIG. 4 (*a*) An enlarged perspective view seeing the needle in a reverse direction against a sewing direction in the needle threading device of sewing machine by the present invention.
Figure 4B:
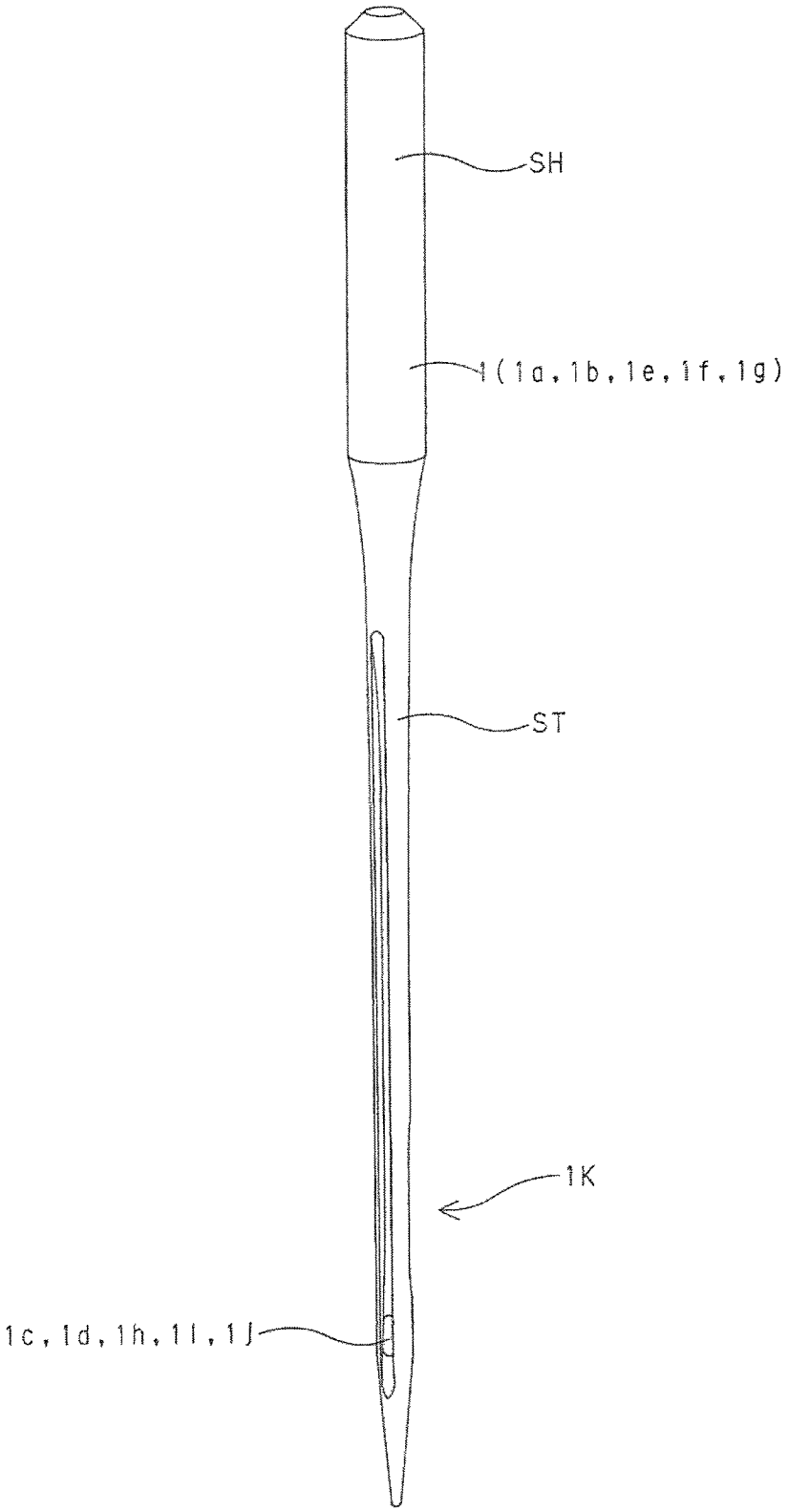
Figure 4C:
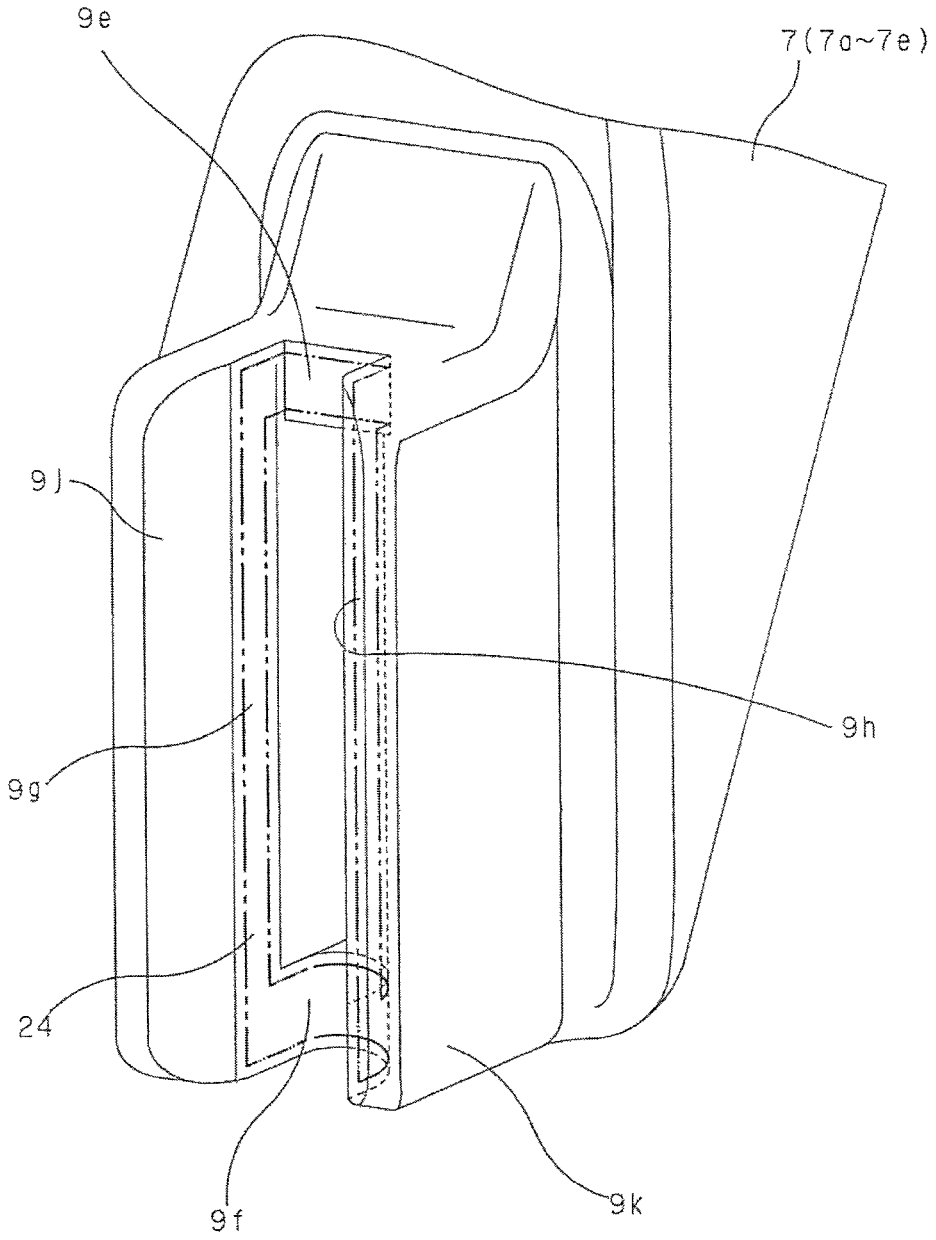
Figure 4D:
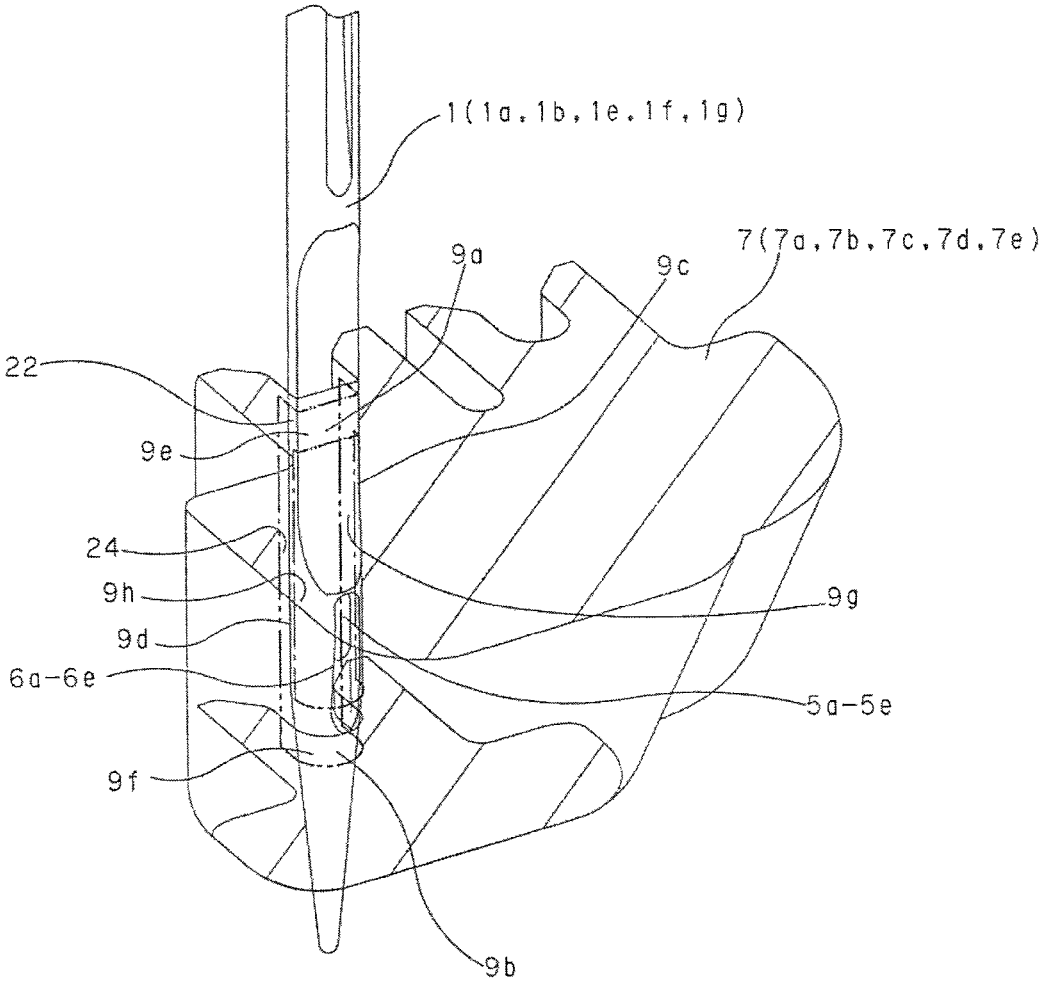
Figure 5A:
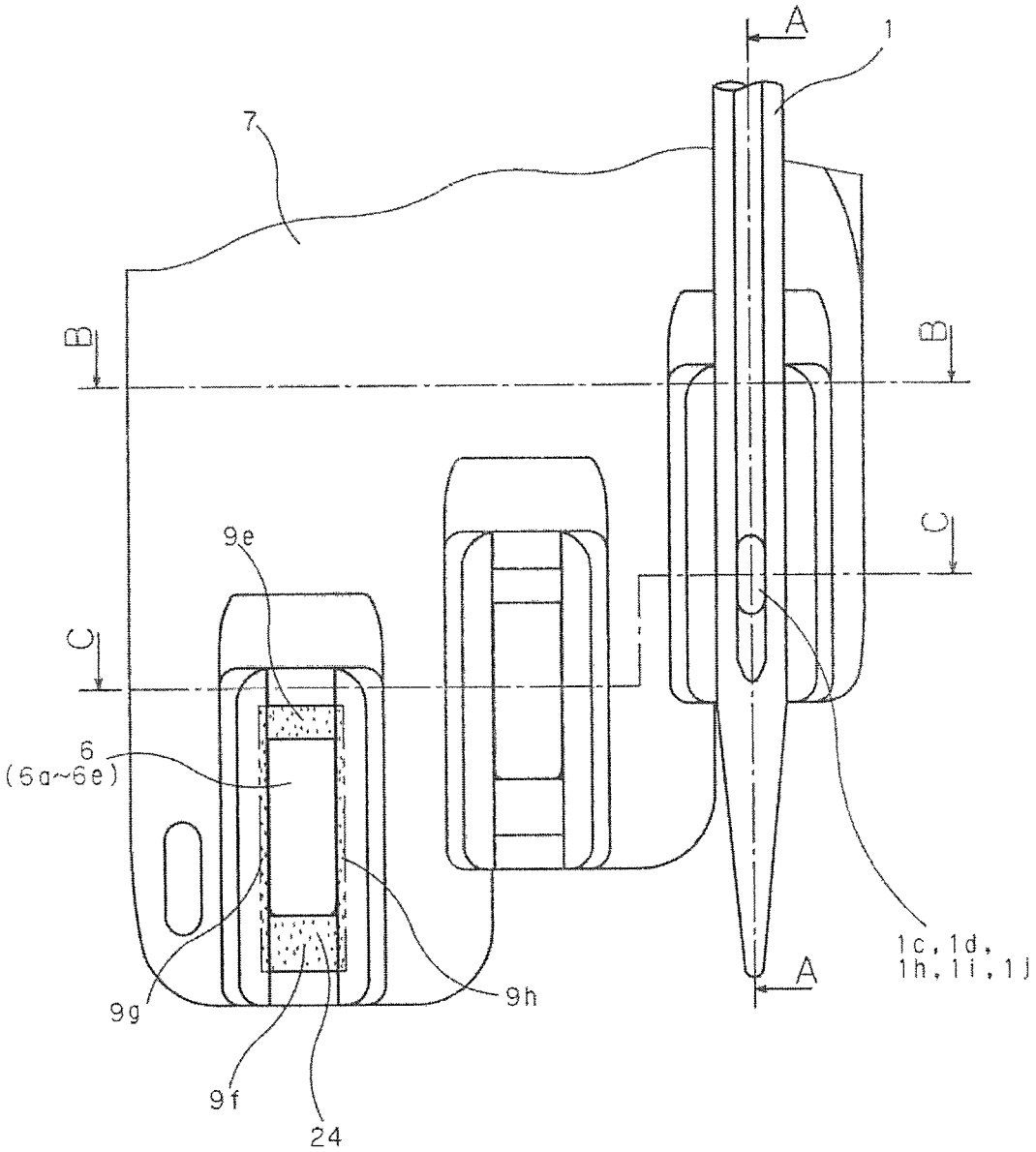
FIG. 5 (*a*A front view seeing the needle and the hermetic lip from a front side at the time of the needle threading state that the hermetic lip touches the needle.
Figure 5B:
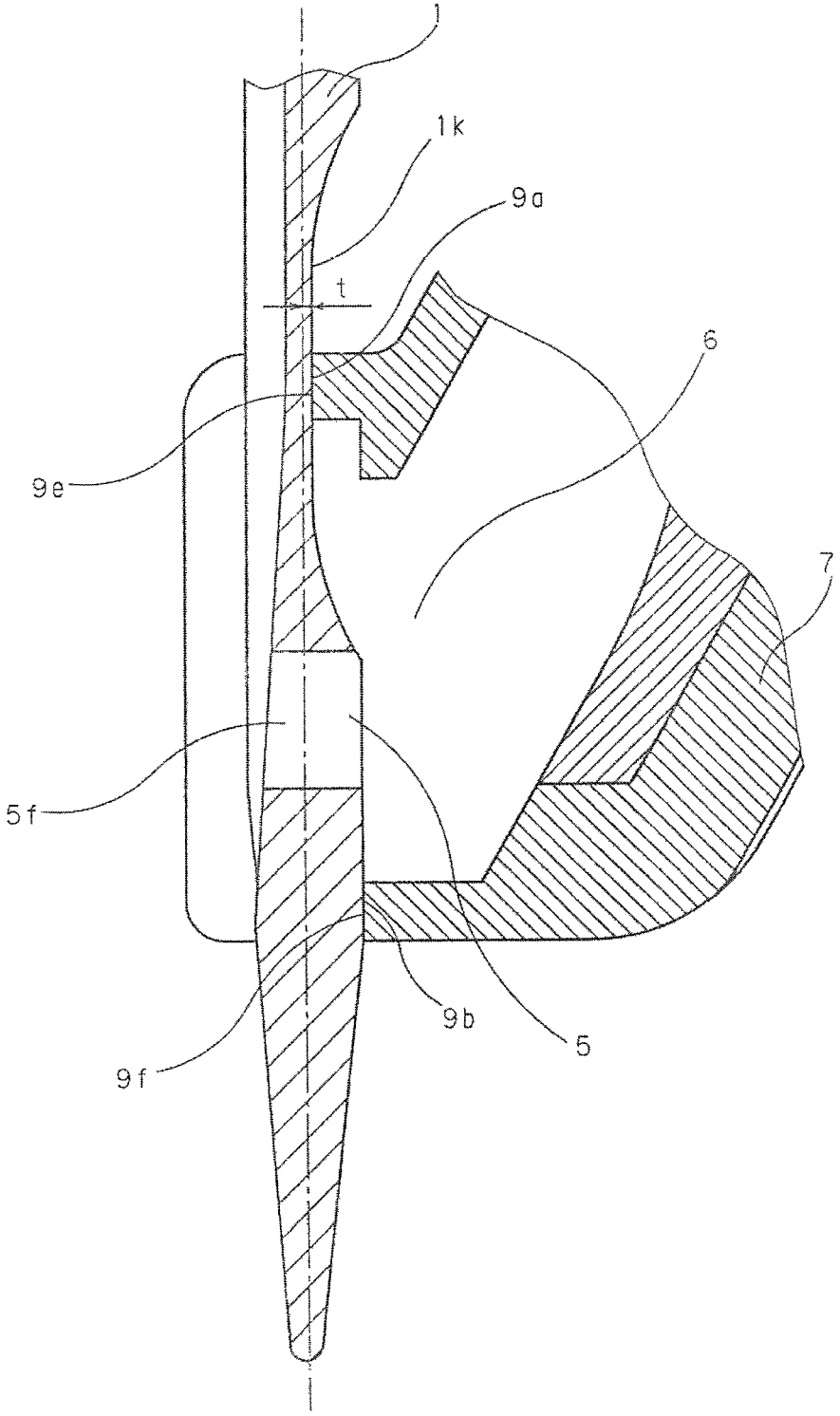
Figure 5C:
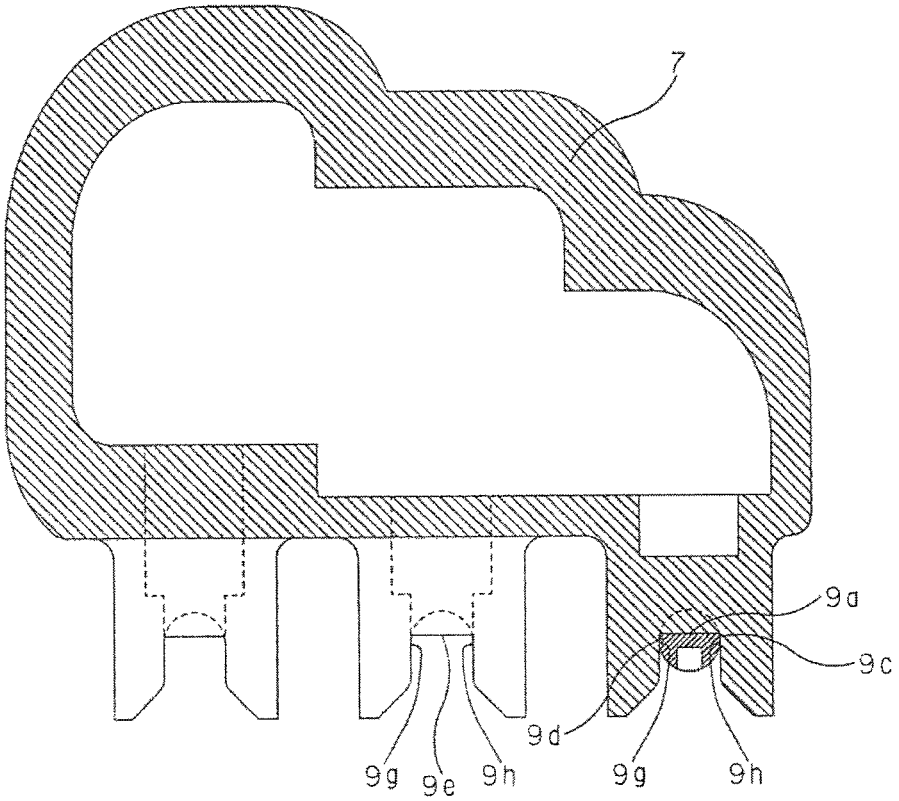
Figure 5D:
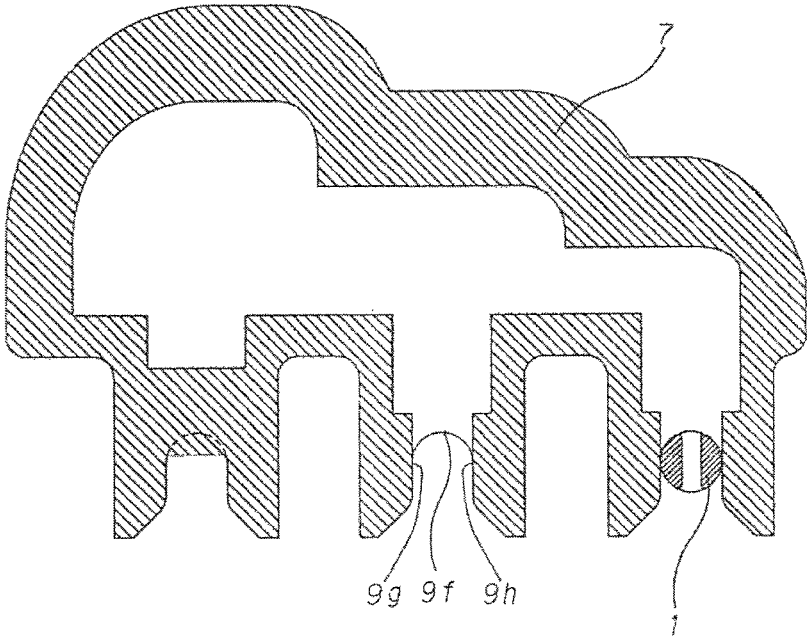

As shown in FIG. 1, FIG. 2 and FIG. 4 (*a*)-FIG. 4 (*d*), a stitch forming apparatus 4 which forms stitches by entangling mutually needle threads 3*a*, 3*b*, 3*c*, 3*d*, 3*e* and looper threads 3*f*, 3*g*, 3*h* which are threaded respectively to needle eyes 1*c*, 1*d* of hemstitch needles 1 (1*a*, 1*b*) noodle eyes 1*h*, 1*i*, 1$_j$ of double chain stitch needles 1 (1*e*, 1*f*, 1*g*) and looper holes 2*d*, 2*e*, 2*f* of loopers 2 (2*a*, 2*b*, 2*c*) as a loop capturing apparatus which cooperates with such needles is provided at a head and the bed of the arm.

The stitch forming apparatus 4 has a needle bar-presser bar unit base 12*a* which has a needle bar 10 and a presser bar 11, and the needle bar 10 is driven vertically movably from the upper shaft US by a needle bar drive mechanism 12*c*. The hemstitch needles 1 (1*a*, 1*b*) and the double chain stitch needles 1 (1*e*, 1*f*, 1*g*) are fixed to the needle bar 10 by a needle clamp 12*b*. Besides, the stitch forming apparatus 4 includes a feed mechanism 15 which sandwiches a cloth WP which should be sewn at the time of sewing between a throat plate 13 and a presser foot 14 which is pressed by the presser bar 11 and feeds every one stitch. The feed mechanism 15 is driven by the lower shaft LS with a looper drive mechanism of the loopers 2 (2*a*, 2*b*, 2*c*).

According to such the 5 (five) needles 8 (eight) threads double chain stitch (cover stitch)-serger (overlook) sewing machine having the stitch forming apparatus 4, the stitch forming of the hemstitch (overlook) on the cloth WP which should be sewn is performed by crossing the needle threads 3*a*, 3*b* which are inserted to the needle eyes 1*c*, 1*d* of the hemstitch needles 1 (1*a*, 1*b*) which vertically move by piercing the throat plate 13, the lower looper thread 3*f* which is inserted to the looper hole 2*d* of the lower looper 2*a* which reciprocates while drawing an arc-like trajectory so to cross the trajectory of the hemstitch needles 1 (1*a*, 1*b*) at the underside of the throat plate 13, and the upper looper thread 3*g* which is inserted to the looper hole of the upper looper 2*b* which reciprocates while drawing the elliptical trajectory so as to cross the trajectory of the lower looper 2*a* at the lateral side of the throat plate 13 and so as to cross the trajectory of the hemstitch needles 1 (1*a*, 1*b*) at the upper side of the throat plate 13, and the stitch forming of the double chain stitch (cover stitch) on the cloth WP which should be sewn is performed by crossing the needle threads 3*c*, 3*d*, 3*e* which are inserted to the needle eyes 1*h*, 1*i*, 1*j* of the double chain stitch needles 1 (i*e*, 1*f*, 1*g*) and the double chain stitch thread 3*h* which is inserted to the looper hole 2*f* of the double chain stitch looper 2*c* which reciprocates while drawing the elliptical trajectory so as to cross the trajectory of the double chain stitch needles 1 (1*e*, 1*f*, 1*g*).

In addition, because the specific structure and the operation of the above-mentioned stitch forming apparatus 4 are public known or well known, the detailed explanations as omitted.

As shown in FIG. 1, FIG. 2 and FIG. 4 (*a*)-FIG. 4 (*d*), the double chain stitch (cover stitch)-serger (overlook) sewing machine has the stich forming apparatus 4 including the hemstitch needles 1 (1*a*, 1*b*) and the double chain stitch needles 1 (1*e*, 1*f*, 1*g*) and the loopers 2 (2*a*, 2*b*, 2*c*) which are the loop capturing apparatus which form stitches by entangling the needle threads 3*a*, 3*b*, 3*c*, 3*d*, 3*e* and the looper threads 3*f*, 3*g*, 3*h* which are threaded to the needle eyes 1*c*, 1*d*, 1*h*, 1*i*, 1*j* of the needles by cooperating with theses needles.

As shown in FIG. 1, FIG. 4 (*a*)-FIG. 4 (*d*) and FIG. 5 (*a*)-FIG. 5 (*d*), according to a feature of the present invention, the double chain stitch (cover stitch)-serger (overlook) sewing machine has a pneumatic threading apparatus 20 which threads pneumatically to the needle eyes 1*c*, 1*d*, 1*h*, 1*i*, 1*j* of the needles.

The pneumatic threading apparatus 20 has a hermetic lip (7*a*, 7*b*, 7*c*, 7*d*, 7*e*) which is hermetically touchable to a peripheral band-ring-shaped region 22 of the needle surrounding thread exit 5 (5*a*, 5*b*, 5*c*, 5*d*, 5*e*) of each needle eye 1c, 1d, 1h, 1i, 1j of the hemstitch needle 1 (1a, 1b) and the double chain stitch needle 1 (1e, 1f, 1g) and which has a corresponding peripheral band-ring-shaped pad 24 surrounding suction port hole 6 (6a, 6b, 6c, 6d, 6e) which sucks from the thread exit 5 (5a, 5b, 5c, 5d, 5e) of the needle eye 1c, 1d, 1h, 1i, 1j of the hemstitch needle 1 (1a, 1b) and the double chain stitch needle 1 (1e, 1f, 1g).

A needle blade ST of the hemstitch needle 1 (1a, 1b) and the double chain stitch needle 1 (1e, 1f, 1g) has a concave part 1k (FIG. 4 (a), FIG. 4 (d)) for passing a loop-taker point of the looper 2 (2a, 2b, 2c) which is the loop capturing apparatus in an upper part of each needle eye 1c, 1d, 1h, 1i, 1j respectively. Besides, as shown in FIG. 4 (a), FIG. 4 (d), FIG. 5 (a)-FIG. 5 (c), the peripheral band-ring-shaped region 22 of the needle of the hemstitch needle 1 (1a, 1b) and the double chain stitch needle 1 (1e, 1f, 1g) has an upper flat shape band region part 9a which intersects, nearly intermediate part of the concave part 1k and extends horizontally, lower semicircular band region part 9b which intersects lower part of each needle eye 1c, 1d, 1h, 1i, 1j and extends horizontally in the needle blade ST and two lateral band region parts 9c and 9d which connect the upper flat shape band region part 9a and the lower semicircular band region part 9b and extend vertically and in a circumferential direction.

Corresponding to this, as shown in FIG. 4 (c), FIG. 4 (d), FIG. 5 (a)-FIG. 5 (d), the peripheral band-ring-shaped pad 24 of the hermetic lip 7 (7a, 7b, 7c, 7d, 7e) has an upper flat shape band segment 9e which extends horizontally, a lower semicircular band segment of which extends horizontally and two lateral band segments 9g and 9h which connect the upper flat shape bend segment 9e and the lower semicircular band segment 9f and extend vertically and in a circumferential direction.

When the hermetic lip 7 (7a, 7b, 7c, 7d, 7e) touches the hemstitch needle 1 (1a, 1b) and the double chain stitch needle 1 (1e, 1f, 1g), in an upper part of the peripheral band-ring-shaped region 22 and the peripheral band-ring-shaped pad 24, an upper convex semicircular edge part segment 9a of the peripheral band-ring-shaped region 22 closely touches the upper flat shape band segment 9e which extends horizontally, and in a lower part of the peripheral band-ring-shaped region 22 and the peripheral band-ring-shaped pad 24, a lower convex semicircular edge part segment 9b of the peripheral band-ring-shaped region 22 closely touches the lower semicircular band segment 9f of the peripheral band-ring-shaped pad 24, and in both lateral parts of the peripheral band-ring-shaped region 22 and the peripheral band-ring-shaped pad 24, two lateral band region parts 9c and 9d of the peripheral band-ring-shaped region 22 closely touch two lateral band segments 9g and 9h of the peripheral band-ring-shaped pad 24 respectively. Thereby, when the hermetic lip 7 (7a, 7b, 7c, 7d, 7e) touches the hemstitch needle 1 (1a, 1b) and the double chain stitch needle 1 (1e, 1f, 1g), the peripheral band-ring-shaped region 22 of the hemstitch needle 1 (1a, 1b) and the double chain stitch needle 1 (1e, 1f, 1g) closely touches the peripheral band-ring-shaped pad 24 of the hermetic lip 7 (7a, 7b, 7c, 7d, 7e). Therefore, when the needle threading is performed pneumatically, because the suction from only the needle eye of the sewing machine needle is possible, the threading of the needle thread can be performed certainly and stably.

In each of hermetic lip 7 (7a, 7b, 7c, 7d, 7e), spreading wings 9j, 9k protrude outward in outspread form to aid easy insertion of the hemstitch needle 1 (1a, 1b) and the double chain stitch needle 1 (1e, 1f, 1g) to the hermetic lip 7 (7a, 7b, 7c, 7d, 7e).

As shown in FIG. 1, FIG. 3, FIG. 11, FIG. 13, in the pneumatic threading apparatus 20, the suction port hole 6 (6a, 6b, 6c, 6d, 6e) of the hermetic lip 7 (7a, 7b, 7c, 7d, 7e) is connected to after-mentioned pump PU through an individual needle thread suction conduit pipe 40a-40e and grouped needle thread suction conduit pipe 41a-41b.

Figure 6:
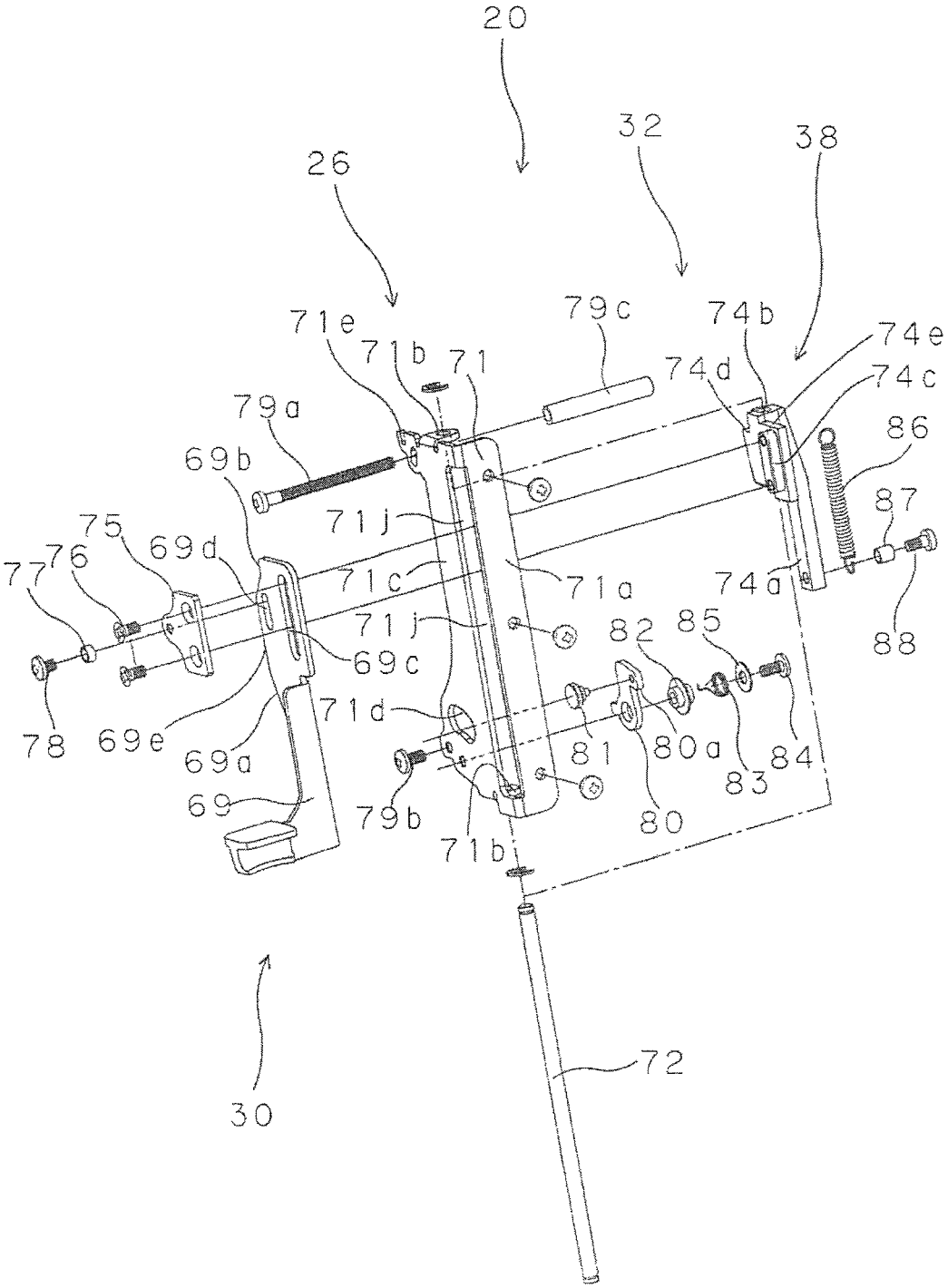
FIG. 6 A partial exploded perspective view showing a position switching mechanism in the needle threading device of sewing may by the present invention.
Figure 7:
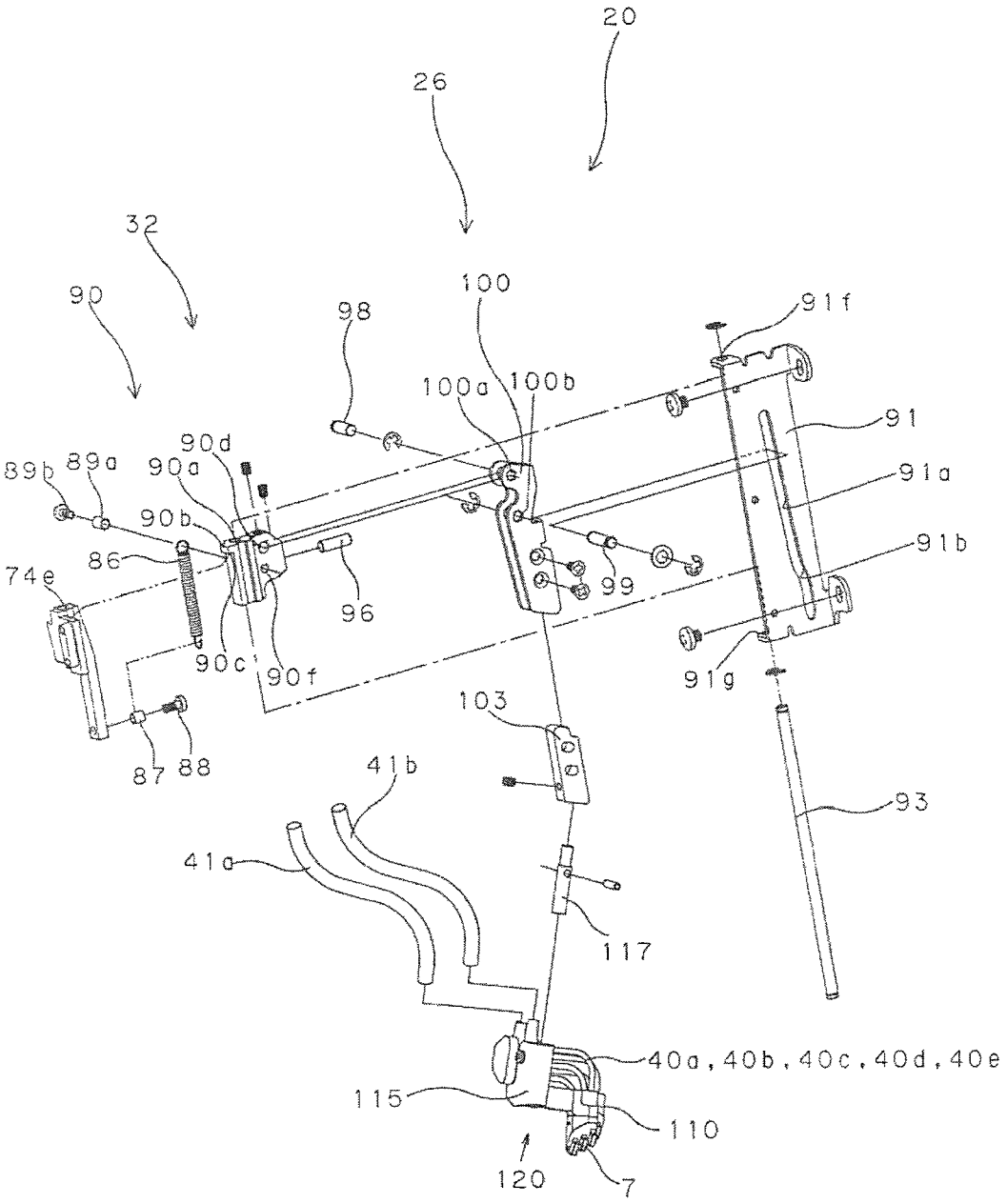
FIG. 7 A partial exploded perspective view showing the position switching mechanism in the needle threading device of sewing machine by the present invention.
Figure 8:
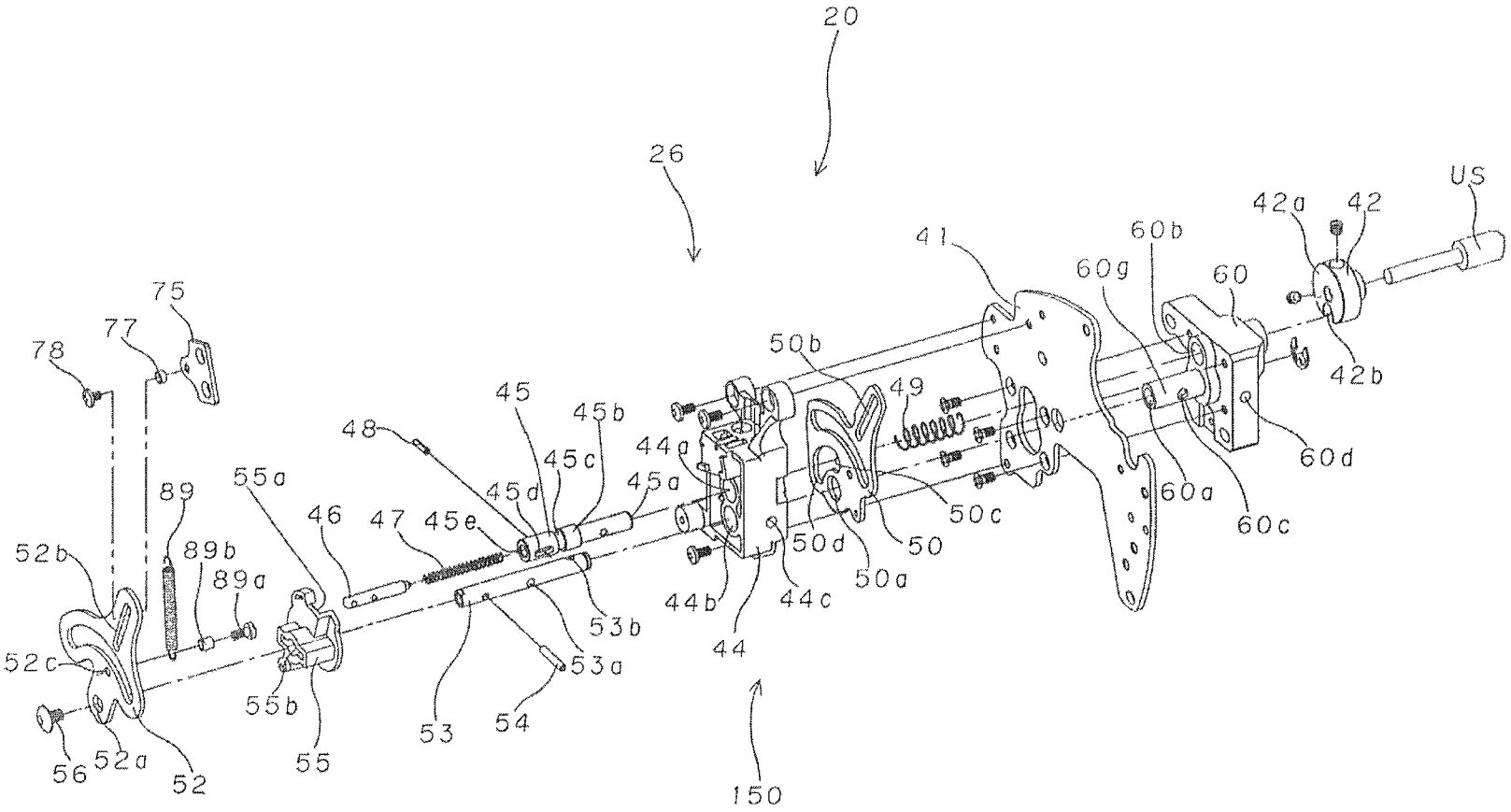
FIG. 8 A partial exploded perspective view showing the position switching mechanism including looper threading positioning part in the needle threading device of sewing machine by the present invention.

As shown in FIG. 6-FIG. 8, the pneumatic threading apparatus 20 has a position switching mechanism 26 which moves the hermetic lip 7 (7a, 7b, 7c, 7d, 7e) to a position of the threading by touching the hemstitch needle 1 (1a, 1b) and the double chain stitch needle 1 (1e, 1f, 1g) so that the suction port hole 6 (6a, 6b, 6c, 6d, 6e) is aligned to each thread exit 5 (5a, 5b, 5c, 5d, 5e) of each needle eye 1c, 1d, 1h, 1i, 1j of the hemstitch needle 1 (1a, 1b) and the double chain stitch needle 1 (1e, 1f, 1g) at the time of the needle threading and moves to a standby position by retreating the hermetic lip 7 (7a, 7b, 7c, 7d, 7e) from the hemstitch needle 1 (1a, 1b) and the double chain stitch needle 1 (1e, 1f, 1g) at the time of the stitch forming.

The pneumatic threading apparatus 20 has the pump PU which is connected to a suction port 28a through the individual needle thread suction conduit pipe 40a-40e and the grouped needle thread suction conduit pipe 41a-41b, and which performs the needle threading to the needle eye 1c, 1d, 1h, 1i, 1j of the hemstitch needle 1 (1a, 1b) and the double chain stitch needle 1 (1e, 1f, 1g) by sucking one end of the needle thread 3a, 3b, 3c, 3d, 3e which is inserted to each thread entrance 5f of each needle eye 1c, 1d, 1h, 1i, 1j of the hemstitch needle 1 (1a, 1b) and the double chain stitch needle 1 (1e, 1f, 1g) to the suction port 28a via the suction port hole 6 (6a, 6b, 6c, 6d, 6e) from each thread exit 5 of the needle eye of the hemstitch needle 1 (1a, 1b) and the double chain stitch needle 1 (1e, 1f, 1g) through the individual needle thread suction conduit pipe 40a-40e and the grouped needle thread suction conduit pipe 41a-41b at the time of the needle threading.

As shown in FIG. 6-FIG. 8, in the threading apparatus 20 of the sewing machine of the present invention, the position switching mechanism 26 has an operation part 30 which is attached to a sewing machine head and forma a preparatory position which becomes a preparatory state of the needle threading by primary manual operation and holds the preparatory position, and has a needle threading positioning part 32 which is moved with the operation part 30 and forms a needle threading position which becomes a needle threading state of the needle threading from the preparatory position with predetermined needle threading timing depending on manual rotating operation, that is, depending on secondary manual operation of the hand pulley HP (FIG. 1, FIG. 2) which is fixed to the lower shaft LS which is the drive shaft.

In the threading apparatus 20 of the sewing machine of the present invention, the operation part 30 has a manual lever 69 which is operated manually and a transmission part 38 which is connected to the manual lever 69 and holds the preparatory position by a stopper 80 and a hook part 74d of the needle threading Positioning part 32. The needle threading positioning part 32 has a control part 90 which is movable through the transmission part 38, and is repelled elastically by a lip drive spring 86, and forms the needle threading position which becomes the needle threading state of the needle threading with predetermined needle threading timing depending on the secondary manual operation of the hand pulley HP and moves the hermetic lip 7 (7a, 7b, 7c, 7d, 7e) which is attached so that the suction port hole 6 (6a, 6b, 6*c*, 6*d*, 6*e*) is aligned to the thread exit 5 (5*a*, 5*b*, 5*c*, 5*d*, 5*e*) of the needle eye 1*c*, 1*d*, 1*h*, 1*i*, 1*j* of the needle and touches the needle.

In the threading apparatus of the sewing machine of the present invention, the needle threading positioning part 32 has a control pin 45 and a positioning pin 99 which pierces a control plate 50 which regulates a movement of the control pin 45, and touches a disc 42 which has a notched part 42*b* which is driven by synchronizing to the needles, and shifts to an axial direction when fitting into the notched part 42*b* depending on the manual rotating operation of the hand pulley HP, that is, depending on the secondary manual operation, and swings the control plate 50, and moves the hermetic lip 7 (7*a*, 7*b*, 7*c*, 7*d*, 7*e*) by the control part 90 so that the suction port hole 6 (6*a*, 6*b*, 6*c*, 6*d*, 6*e*) is aligned to the thread exit 5 (5*a*, 5*b*, 5*c*, 5*d*, 5*e*) of the needle eye 1*c*, 1*d*, 1*h*, 1*i*, 1*j* of the hemstitch needle 1 (1*a*, 1*b*) and the double chain stitch needle 1 (1*e*, 1*f*, 1*g*) and touches the needle.

A structure of the threading apparatus 20 of the sewing machine which is composed in this way is explained in more detail. As shown in FIG. 6-FIG. 8, in the position switching mechanism 26 of the threading apparatus 20 of the sewing machine, a threading set lever shaft 72 is attached in a threading set lever shaft attaching hole 71*b* of a threading set lever plate 71 which is fixed to the needle bar-presser bar unit base 12*a* of a sewing machine arm head by screws 79*a*, 79*b* and a pipe 79*c*, and in the transmission part 38, the threading set lever shaft 72 is attached to a threading set lever shaft sliding hole 74*b* and slides. The manual operation lever 69 for the primary manual operation is attached to an attaching part 74*c* of the transmission part 38 by setscrews 76 via a slit 71*j* of the threading set lever plate 71 through a threading set lever arm lid 75 from a long groove 69*c*. The manual operation lever 69 slides on a manual lever sliding surface 71*c*. In ordinary state of the transmission part 38 and the control part 90, one of the lip drive spring 86 is attached to a spring attaching arm 74*a* by a spacer 87 and a screw 88 and the other is connected in a pad 74*e* and a pad 90*b* by a spacer 89*a* and a screw 89*b*.

The stopper 80 is provided at the threading set lever plate 71 by a stopper shaft 82, a washer 85 and a setscrew 84 by being repelled elastically clockwise with a stopper spring 83. A stopper release shaft 81 is provided at the stopper 80 by exposing from a stopper release shaft clearance hole 71*d* of the threading set lever plate 71. A lower inclination cam 69*a*, an upper inclination cam 69*b* and a straight cam 69*e* which connects both cams that the stopper release shaft 81 slides is provided at the manual operation lever 69. In the ordinary state, the stopper 80 is repelled elastically clockwise by the stopper spring 83, and the stopper release shaft 81 is located below the lower inclination cam 69*a* in the manual operation lever 69. When the manual operation lever 69 as the primary manual operation slides on the threading set lever shaft 72 with the transmission part 38 and is operated downward, the stopper release shaft 81 slides on the straight cam 69*e* from the lower inclination cam 69*a* and rotates the stopper 80 counterclockwise, and further slides on the upper inclination cam 69*b* and rotates the stopper 80 clockwise, and the hook part 74*d* of the transmission part 38 is locked at a hook part 80*a* of the stopper 80. This state is the above-mentioned preparatory position in the hermetic lip 7 (7*a*, 7*b*, 7*c*, 7*d*, 7*e*).

The lip drive spring 86 is suspended between the attaching part 74*c*, the spacer 87 of the screw 88 of the transmission part 38 and an attaching hole 90*f*, a screw 86*a* and a spacer 86*b* of the control part 90. A lip drive arm 100 is attached pivotally to the control part 90 by a pin 98 which pierces a swing hole 100*a* and is fixed to an attaching hole 90*d*, and a lip drive guide shaft 93 which is attached to lip drive guide shaft attaching holes 91*f*, 91*g* of a lip guide plate 91 which is attached to a lip guide plate attaching surface 71*a* is supported pivotally at a lip drive guide shaft attaching hole 90*a* of the control part 90. The lip drive arm 100 is fitted into a cam 91*a* of the lip guide plate 91 slidably by a positioning pin 99 which is attached pivotally to a pin hole 100*b*. Because the lip drive arm 100 must be located adjacent to a left side of a lateral direction of the presser bar 11 of the stitch forming apparatus 4, when the manual operation lever 69 descends as the primary manual operation, a deformation cam 91*b* following the cam 91*a* that the lip drive arm 100 slides by the positioning pin 99 moves the lip drive arm 100 to a right side of a lateral direction, and the suction port hole 6 (6*a*, 6*b*, 6*c*, 6*d*, 6*e*) of the hermetic lip 7 (7*a*, 7*b*, 7*c*, 7*d*, 7*e*) is aligned to each thread exit 5 (5*a*, 5*b*, 5*c*, 5*d*, 5*e*) of each needle eye 1*c*, 1*d*, 1*h*, 1*i*, 1*j* of the hemstitch needle 1 (1*a*, 1*b*) and the double chain stitch needle 1 (1*e*, 1*f*, 1*g*) at the time of the needle threading. On the other hand, the lip drive arm 100 is connected to the hermetic lip 7 (7*a*, 7*b*, 7*c*, 7*d*, 7*e*) through a lip guide arm 103, a lip holder shaft 117 and a lip holder 110.

On the other hand, a receiving part 77 which is supported rotatably to the threading set lever arm lid 75 by a receiving setscrew 78 is fitted into a threading lever connecting groove 52*b* of an inclination cam actuation arm plate 52 in the needle threading positioning part 32. In addition, a tip of the receiving setscrew 78 is fitted into a long groove 69*d* of the manual operation lever 69 and becomes its escape. The inclination cam actuation arm plate 52 is repelled elastically upward by a lip return spring 89 which is suspended between a spring stud 71*e* of the threading set lever plate 71 and an attaching hole 52*c* of the inclination cam actuation arm plate 52, the screw 89*b* and the spacer 89*a*, and rotates clockwise by descending operation of the manual operation lever 69. A flow channel switching valve 53 (FIG. 8, FIG. 12 (*a*), FIG. 12 (*b*), FIG. 13) of a flow channel switching apparatus 150 which has a suction and exhaust release shaft pin 54 and extends horizontally is fixed to the inclination cam actuation arm plate 52 by a screw 56 through a suction and exhaust release shaft connecting hole 55*b* of an inclination cam body 55 and a cam body attaching hole 52*a*.

A lip drive pin 96 which is provided at the control part 90 is fitted into a lip drive pin connecting groove 50*b* of the control plate 50 in the needle threading positioning part 32. The flow channel switching valve 53 is connected to a suction and exhaust release shaft through-hole 60*a* of a flow channel control main body 60 through a valve through-hole 44*b* of a flow channel control main body 44, a valve through-hole 50*a* of the control plate 50 and a needle threading attaching plate 41.

In the above-mentioned control pin 45 which has a preparatory position large diameter part 45*b* and a threading position small diameter part 45*c*, a tip of a cam follower connecting shaft 46 touches an inclination cam 55*a* of the inclination cam body 55 through an actuation spring 47 on the one hand, and a pin end 45*a* touches an end face 42*a* of the disc 42 which rotates synchronously at the lower shaft LS which has the notched part 42*b* and is the drive shaft through a control pin through-hole 44*a* of the flow channel control main body 44, a pin fitting large diameter hole 50*c* of the control plate 50, a spring 49, the needle threading attaching plate 41 and a control pin through-hole 60*b* of the flow channel control main body 60 on the other hand. In addition, the actuation spring 47 is set between a housing hole 45*e* of the control pin 45 and one end of the cam follower connecting shaft 46 which prevents slipping off by a pin 48 which is fitted into a long hole 45*d*.

Figure 11:
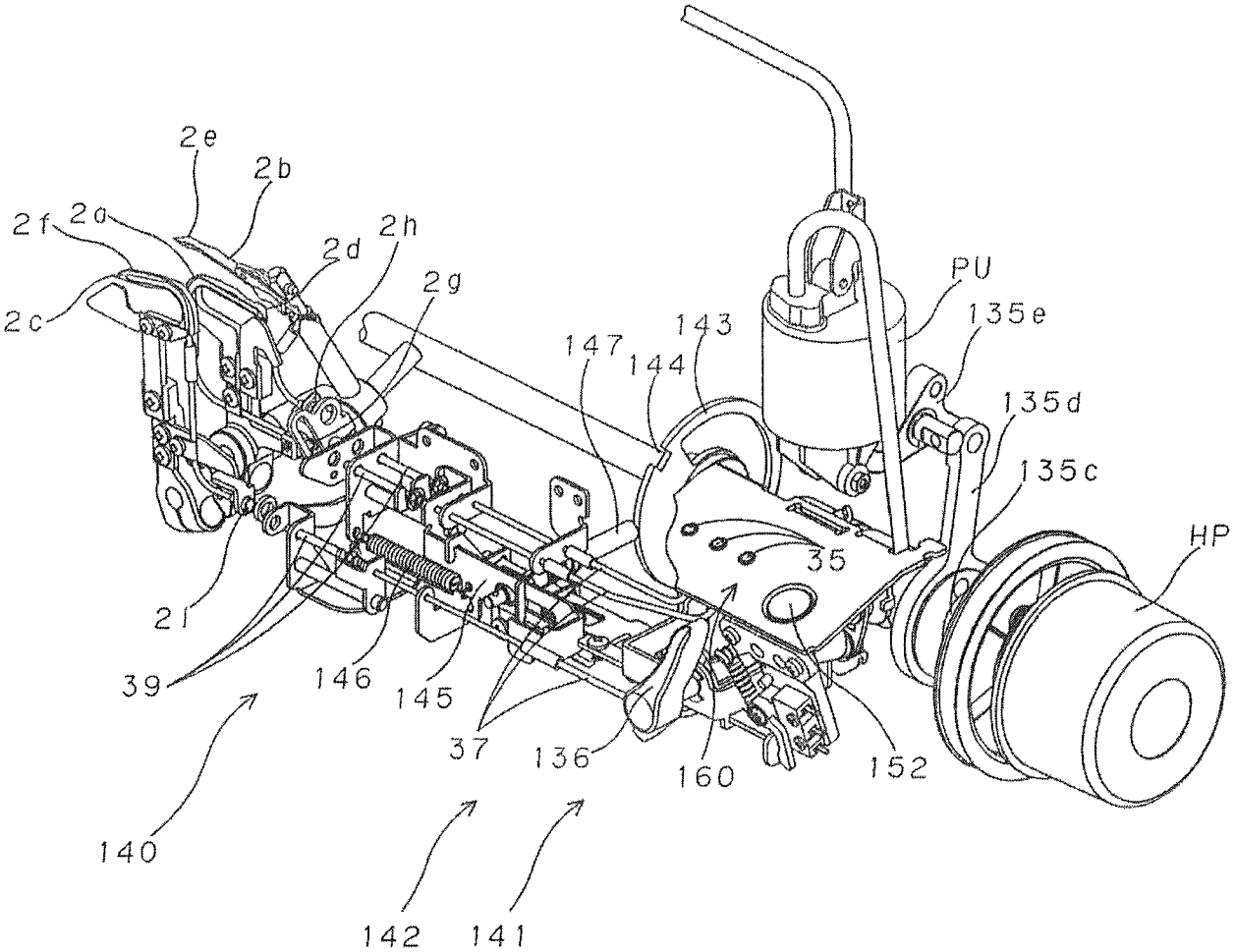
FIG. 11 An explanatory view of a pump and a looper threading apparatus using the needle threading device of sewing machine by the present invention.
Figure 13:
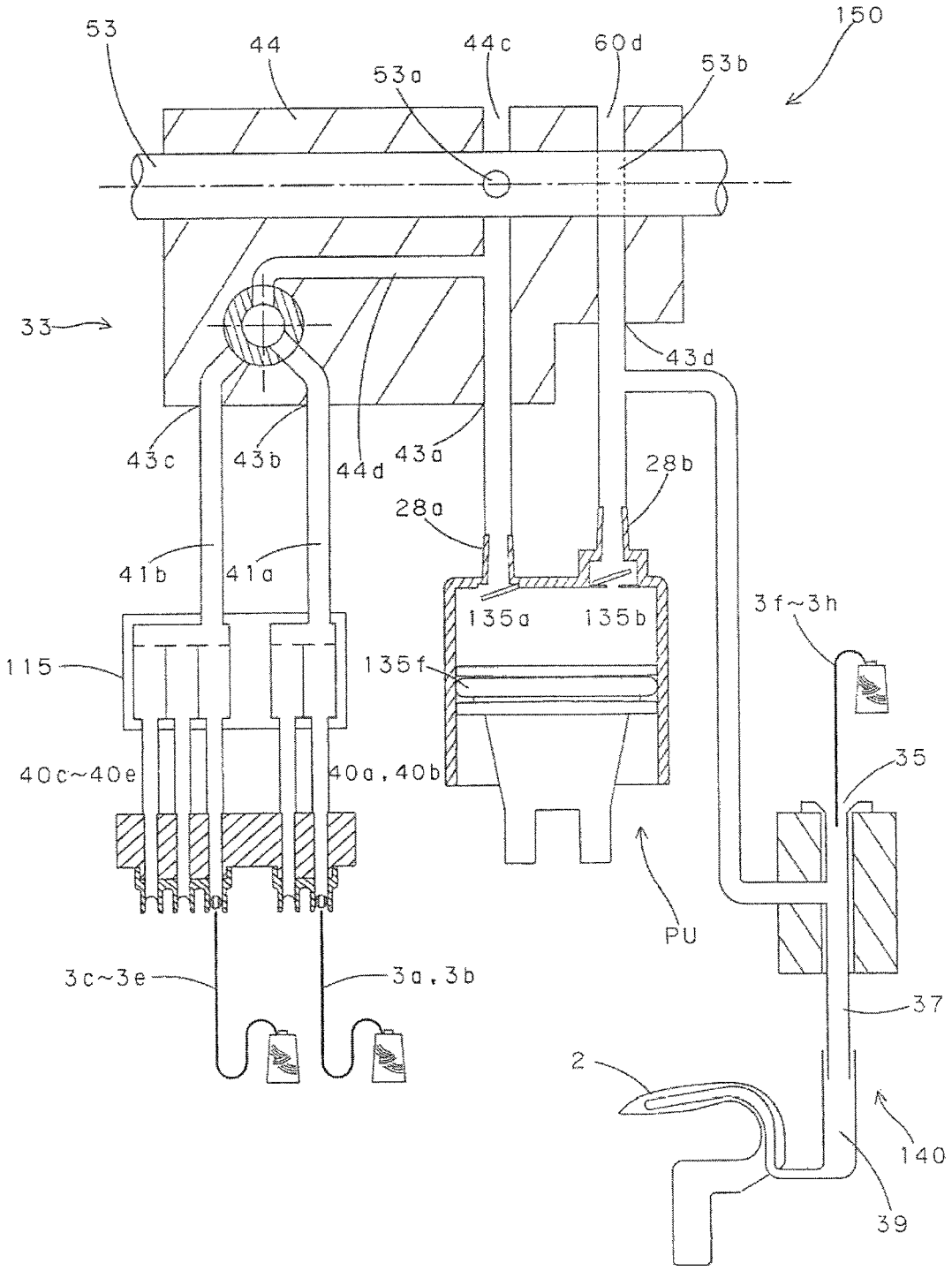
FIG. 13 A schematic explanatory view for explaining the needle threading device of sewing machine by the present invention.

As shown in FIG. 1, FIG. 11, FIG. 13, the pump PU is a reciprocating type in an illustrated embodiment, and is driven by a pump motor M2, and has an exhaust port 28*b* and an exhaust valve 135*b* together with a suction port 28*a* and a suction valve 135*a*. The pump motor M2 rotates an eccentric cam 135*c* through a belt V and a pulley PP, and this rotary motion reciprocates a piston 135*f* of the pump PU by reciprocating linear motion which is transformed through a drive rod 135*d* and a swing link 135*e*. The pump PU may be rotary type.

In the threading apparatus 20 of the sewing machine, the hermetic lip 7 (7*a*, 7*b*, 7*c*, 7*d*, 7*e*) is formed by one material selected from flexible rubbers, plastics and corks. Besides, in the threading apparatus of the sewing machine, the hermetic lip 7 (7*a*, 7*b*, 7*c*, 7*d*, 7*e*) is formed by one material selected from flexible or elastic rubbers, plastics and corks which do not impair the flexibility. Generally, a situation to change for needle of different thickness may be caused depending on thread properties, thickness and/or cloth properties, thickness. On the other hand, it is prescribed that distance t (FIG. 5 (*b*)) of lateral surface of the concave part 1*k* of the needle that the looper 2 as the loop capturing apparatus passes and that center of the needle is constant. Therefore, because the hermetic lip 7 (7*a*, 7*b*, 7*c*, 7*d*, 7*e*) is formed by one material selected from flexible rubbers, plastics and corks or is formed by one material selected from flexible or elastic rubbers, plastics and corks which do not impair that flexibility, when changing the noodle to the different thickness, adhesion of the peripheral band-ring-shaped region 22 of the hemstitch needle 1 (1*a*, 1*b*) and the double chain stitch needle 1 (1*e*, 1*f*, 1*g*) and the peripheral band-ring-shaped pad 24 of the hermetic lip 7 (7*a*, 7*b*, 7*c*, 7*d*, 7*e*) can be secured.

Figure 9A:
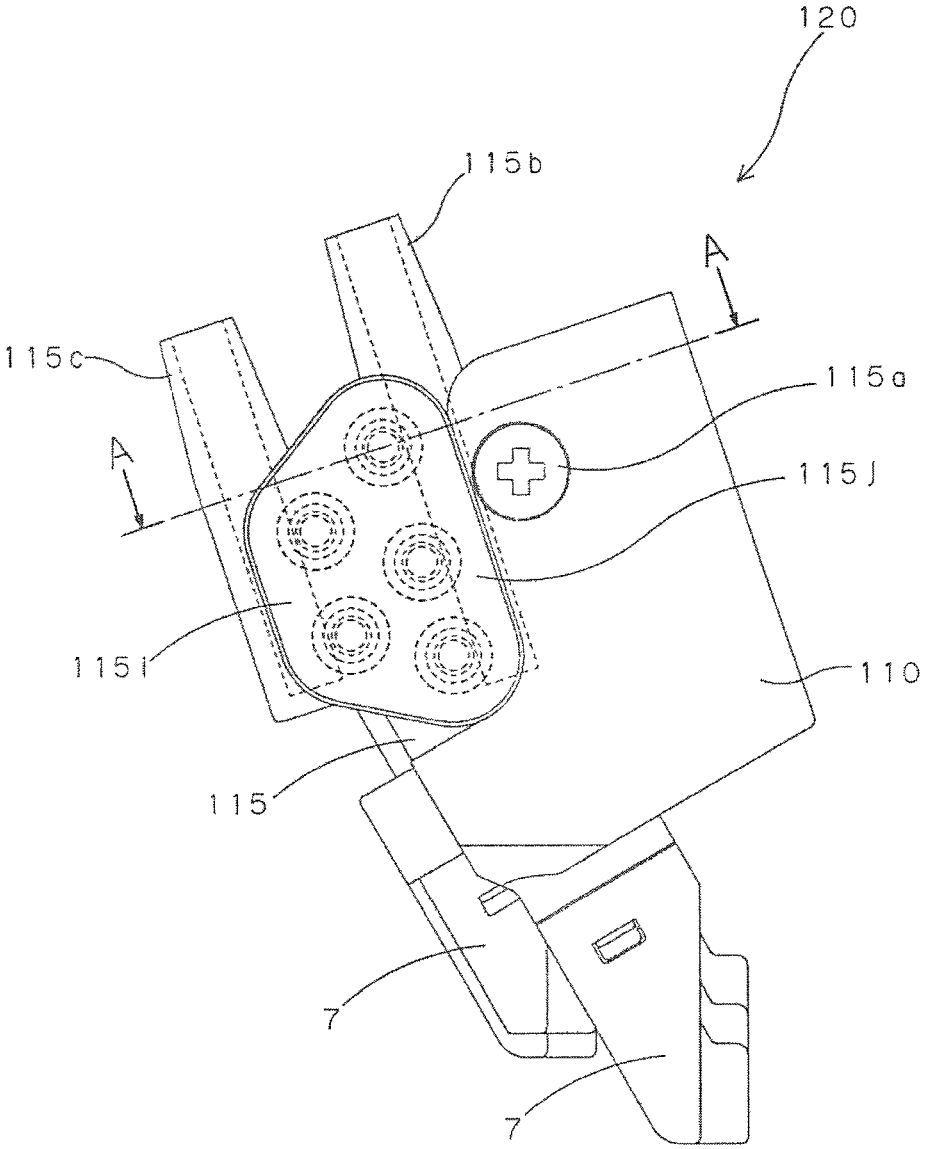
FIG. 9 (*a*) An external view of a separator in the needle threading device of sewing machine by the present invention.
Figure 9B:
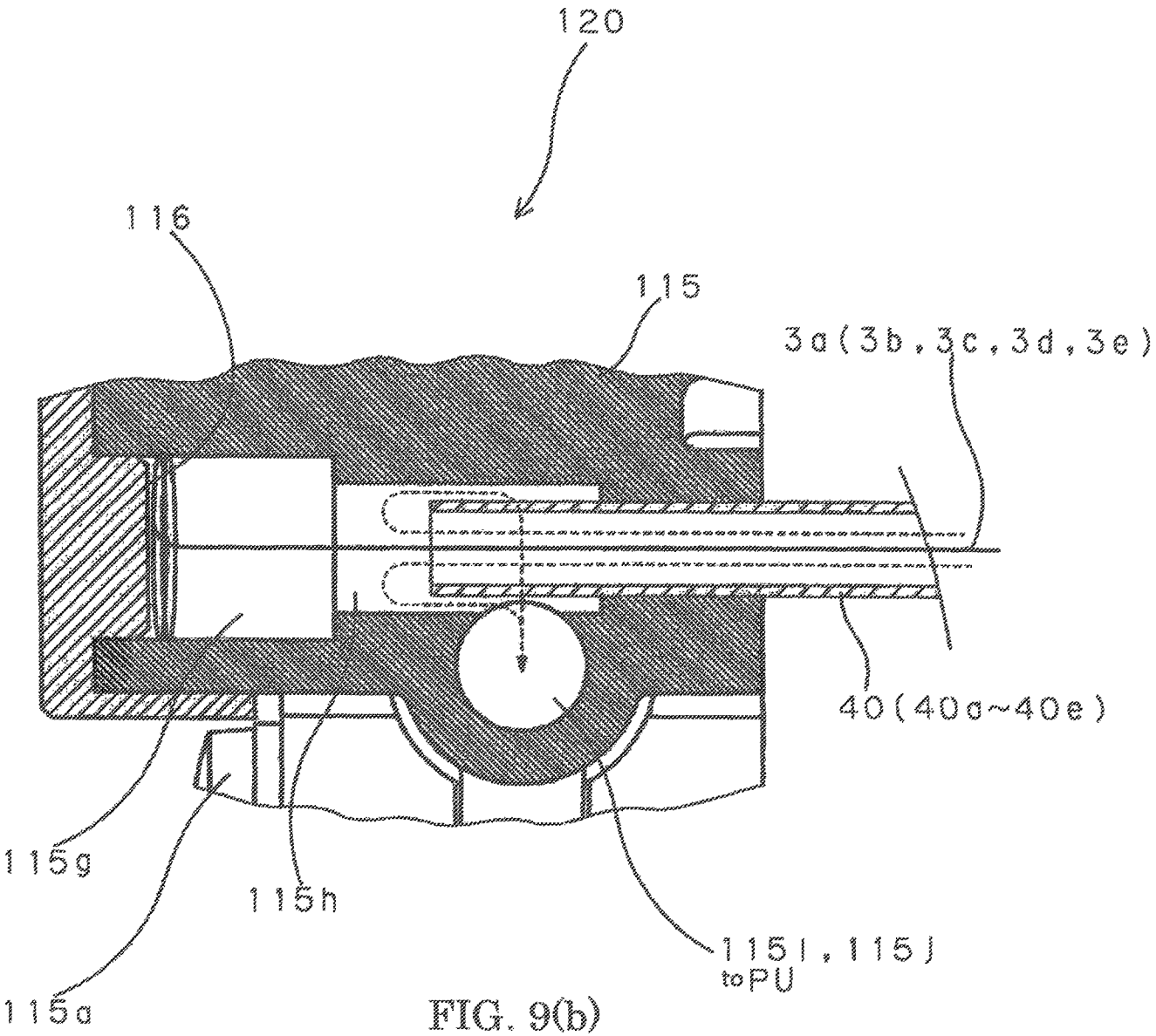

As shown in FIG. 9 (*a*)-FIG. 9 (*b*) and FIG. 13, A separator main body 115 is inserted to the above-mentioned lip holder 110 and fixed by a screw 115*a*. In the threading apparatus 20 of the sewing machine of the present invention, between the noddle thread suction conduit pipe 40*a*-40*e* and the pump PU, a separator 120 which has a thread stopping wall 116 that the needle thread 3*a* (3*b*, 3*c*, 3*d*, 3*e*) which is carried by the suction from the needle thread suction conduit pipe 40*a*-40*e* collides and a space 115*g* which prevents that flow velocity of air which collides against the thread stopping wall 116 is lower than flow velocity which is carried by the suction toward the pump PU and the needle thread 3*a* (3*b*, 3*c*, 3*d*, 3*e*) which is stopped by the collision against the thread stopping wall 116 is sucked toward the pump PU is provided.

That is, in the separator main body 115, a space 115*h* is communicated with flow channels 115*i*, 115*j*, and is connected to the suction port 28*a* of the pump PU. The needle thread 3*a* (3*b*, 3*c*, 3*d*, 3*e*) which is carried by the suction and has large inertial force become lower than the flow velocity which is carried by the suction toward the pump PU in the flow velocity of air which collides against the thread stopping wall 116, in other words, the needle thread 3*a* (3*b*, 3*c*, 3*d*, 3*e*) collides against the thread stopping wall 116 of the separated space 115*g*, and is stopped and is left behind, where the needle thread and the air are separated. On the other hand, in the space 115*h*, air of small inertial force turns suddenly toward the flow channel which connects to the pump PU, and the space 115*h* becomes the flow channel of the sucked air, and is sucked from the flow channels 115*i*, 115*j* by needle thread suction conduit pipe 41*a* (41*b*) by the pump PU.

The hermetic lip 7 (7*a*, 7*b*, 7*c*, 7*d*, 7*e*) is provided one by one for each hemstitch needle 1 (1*a*, 1*b*) and double chain stitch needle 1 (1*e*, 1*f*, 1*g*), and similarly, the separator 120 is also provided one by one for each hemstitch needle 1 (1*a*, 1*b*) and double chain stitch needle 1 (1*e*, 1*f*, 1*g*).

Figure 10A:
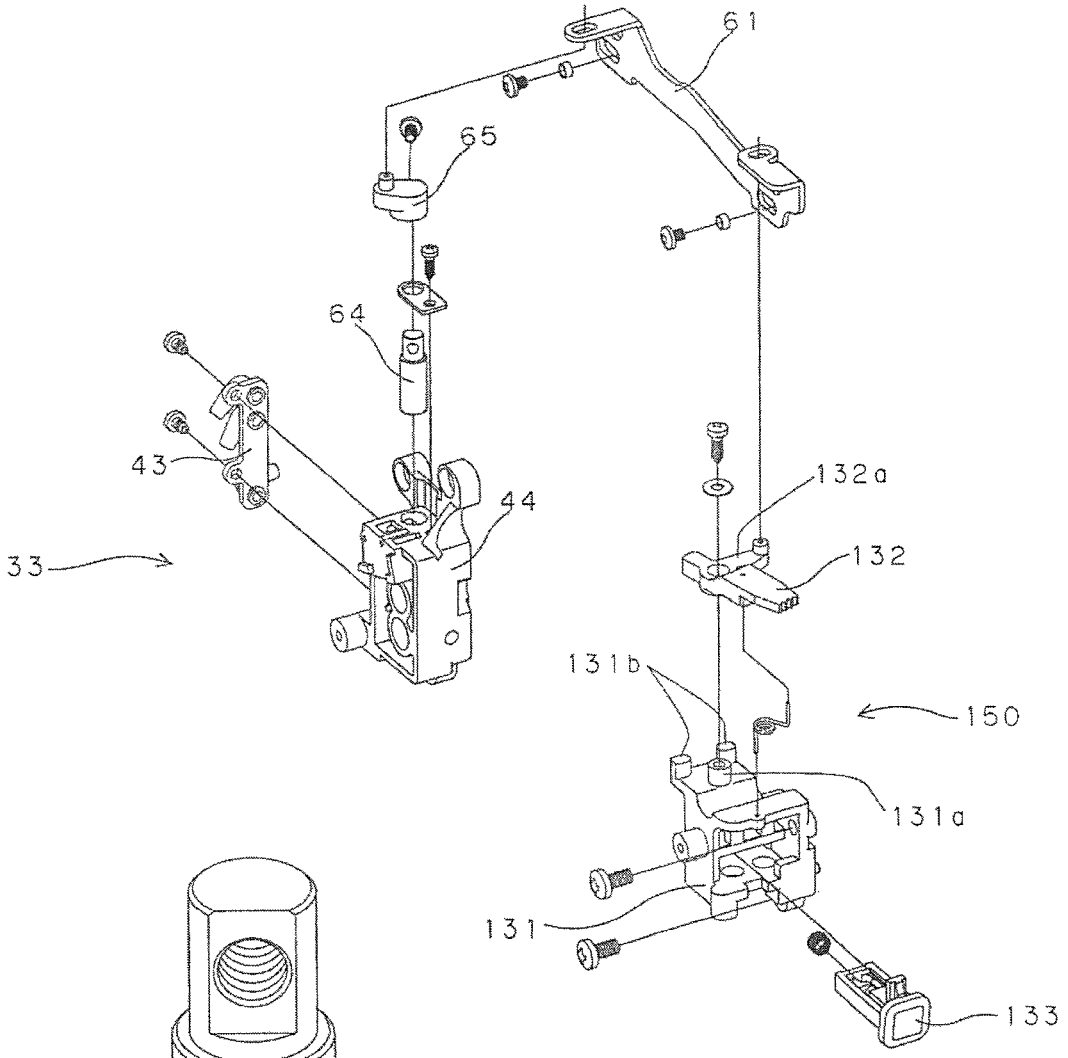
FIG. 10 (*a*) (A) is an exploded perspective view of a flow channel selection apparatus in the needle threading device of sewing machine by the present invention and (B) is a perspective view of a selection valve of the flow channel selection apparatus.
Figure 10A:
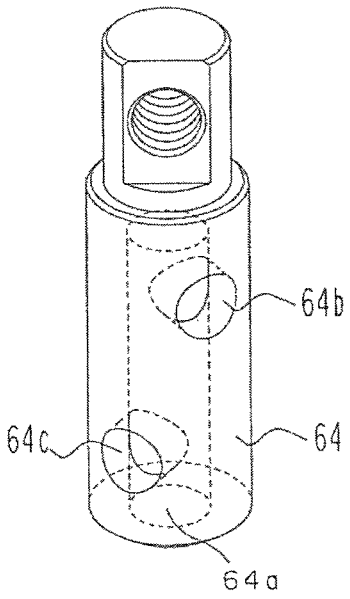
Figure 10B:
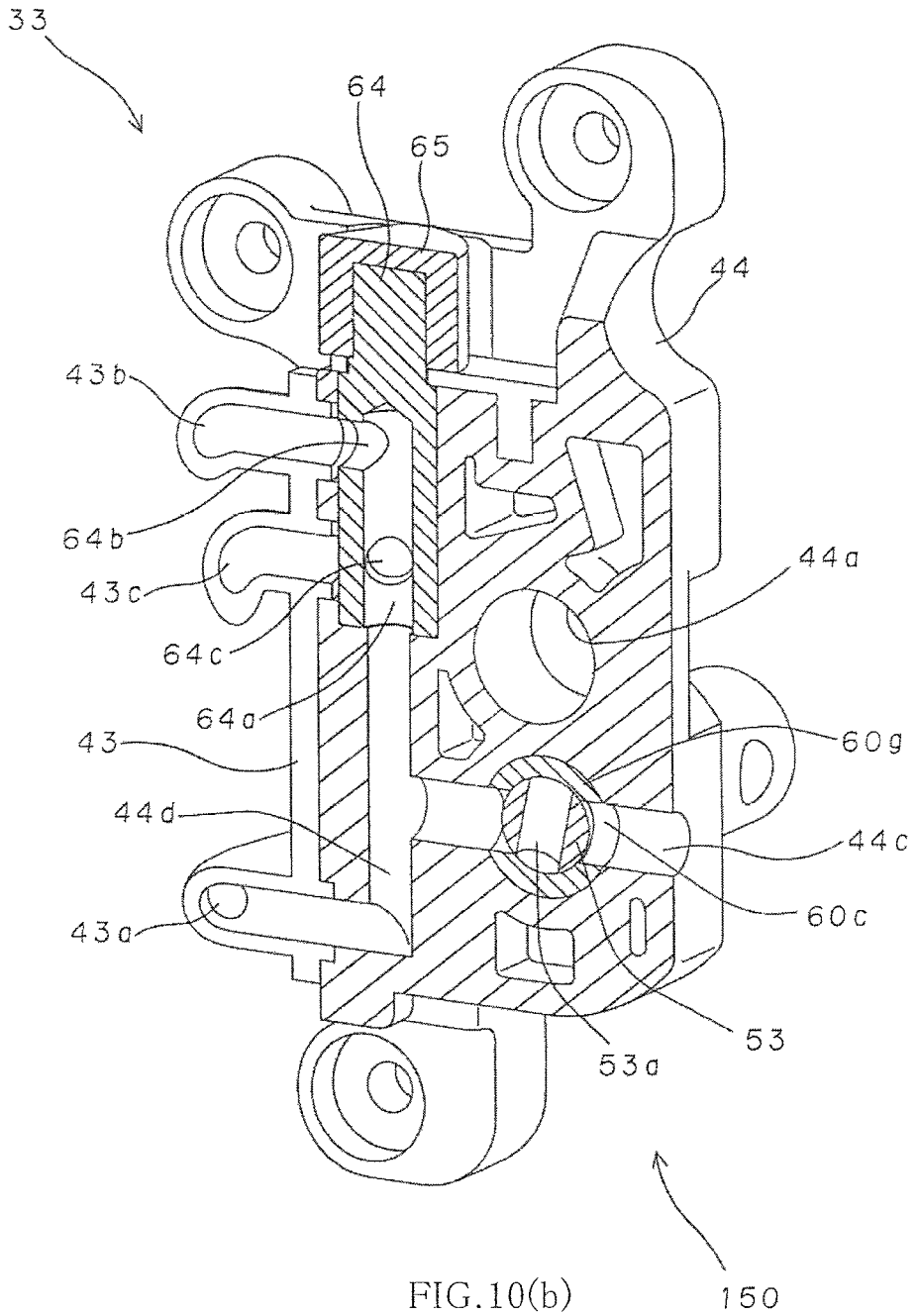

As shown in FIG. 8, FIG. 10 (*a*)-FIG. 10 (*b*) and FIG. 13, in the threading apparatus 20 of the sewing machine of the present invention, the needle is composed with multiple hemstitch needles 1 (1*a*, 1*b*) and double chain stitch needles 1 (1*e*, 1*f*, 1*g*), and in order to reduce the size and the capacity of the pump PU, these multiple needles are divided into at least two groups, in other words, these multiple needles are divided into the hemstitch needles 1 (1*a*, 1*b*) and the double chain stitch needles 1 (1*e*, 1*f*, 1*g*), and a flow channel selection apparatus 33 which selects each hemstitch needle 1 (1*a*, 1*b*) and double chain stitch needle 1 (1*e*, 1*f*, 1*g*) of the two groups and connects to the suction port 28*a* of the pump PU is provided.

That is, a flow channel selection pipe 64 which has an suction exit hole 64*a* which extends vertically is built in the flow channel control main body 44 of the flow channel selection apparatus 33, and that intermediate part has a suction entrance hole for hemstitch needle 64*b* and a suction entrance hole for double chain stitch needle 64*c*, and those angles are 90 degrees out of phase. Corresponding to this, the flow channel control main body 44 has a suction exit hole 43*a*, a suction entrance hole for hemstitch needle 43*b* and a suction entrance hole for double chain stitch needle 43*c*. The suction exit hole 43*a* is connected to the pump PU. The suction entrance hole for hemstitch needle 64*b* and the suction entrance hole for double chain stitch needle 64*c* are connected to the suction entrance hole for hemstitch needle 43*b* and the suction entrance hole for double chain stitch needle 43*c* respectively. In the flow channel selection apparatus 33, a flow channel selection lever 132 for selecting the flow channel either suction entrance hole for hemstitch needle 64*b* and suction entrance hole for hemstitch needle 43*b* or suction entrance hole for double chain stitch needle 64*c* and suction entrance hole for double chain stitch needle 43*c* is supported pivotally to a pivot 131*a* of a flow channel selection lever base 131 between two stoppers 131*b*, and is connected to a flow channel selection arm 65 of the flow channel selection pipe 64 by a flow channel selection link 61 from a flow channel selection arm 132*a* of the flow channel selection lever 132, and the flow channel selection is performed by changing swinging motion by the flow channel selection arm 132*a* of the flow channel selection lever 132 to swinging motion by the flow channel selection arm 65 through the link 61 and by changing to rotary motion of the flow channel selection pipe 64.

Besides, as mentioned above, in the threading apparatus 20 of the sewing machine of the present invention, this sewing machine has the stitch forming apparatus 4 which forms the stitches by entangling the needle thread 3*a*, 3*b*, 3*c*, 3*d*, 3*e* and the looper thread 3*f*, 3*g*, 3*h* which are threaded respectively to the needle eye 1*c*, 1*d*, 1*h*, 1*i*, 1*j* of the needle and the looper hole 2*d*, 2*e*, 2*f* of the looper by cooperating with the looper 2 (2*a*, 2*b*, 2*c*) as the loop capturing apparatus.

As shown in FIG. 1-FIG. 2 and FIG. 11, FIG. 13, the threading apparatus 20 of the sewing machine has looper thread introduction entrance 35 that the exhaust port 28*b* of the pump is connected, looper thread guide conduit pipe 37 which is connected to the looper thread introduction entrance and carries one end of the looper thread 3*f*, 3*g*, 3*h* which is inserted to the looper thread introduction entrance 35 by the compressed air from the exhaust port 28*b*, a looper thread connecting conduit pipe 39 which is fitted into the looper thread guide conduit pipe 37 in the nested state and touches a looper hole entrance 2*g*, 2*h*, 2*i* of the looper 2 (2*a*, 2*b*, 2*c*) at the time of the looper threading and a conduit pipe connecting mechanism 140 which makes the looper thread connecting conduit pipe 39 touch the looper hole entrance 2*g*, 2*h*, 2*i* of the looper and performs the looper threading to the looper hole 2*d*, 2*e*, 2*f* of the looper through the looper thread connecting conduit pipe 39 via the looper thread guide conduit pipe 37 from the looper thread introduction entrance 35 about one end of the looper thread 3*f*, 3*g*, 3*h* which is inserted to the looper thread introduction entrance 35 at the time of the looper threading and separates the looper thread connecting conduit pipe 39 from the looper hole entrance 2*g*, 2*h*, 2*i* of the looper at the time of the stitch forming. This mechanism itself is disclosed in JP4741701B=U.S. Pat. No. 8,925,472B.

In the threading apparatus of the sewing machine of the present invention, the conduit pipe connecting mechanism 140 has an operation part 141 which is attached to the sewing machine bed, and forms the preparatory position which becomes the preparatory state of the looper threading by the manual operation of a looper threading lever 136, that is, by the primary manual operation, and holds the preparatory position and a looper threading positioning part 142 which forms a looper threading position which becomes looper threading state of the looper threading with predetermined looper threading timing depending on the manual rotating operation of the hand pulley HP, that is, depending on the secondary manual operation from the preparatory position.

In the threading apparatus of the sewing machine of the present invention, the looper threading positioning part 142 has a positioning pin 147. The positioning pin 147 is driven by synchronizing to the looper, and touches a disc 143 which has a notched part 144, and shifts to an axial direction when fitting into the notched part depending on the manual rotating operation of the hand pulley HP, that is, depending on the secondary manual operation, and moves a support plate 145 of the looper thread connecting conduit pipe 39 in the conduit pipe connecting mechanism 140 by a spring 146 so that the looper thread connecting conduit pipe 39 is aligned and touched to the looper hole entrance 2*g*, 2*h*, 2*i* of the looper.

Figure 12A:
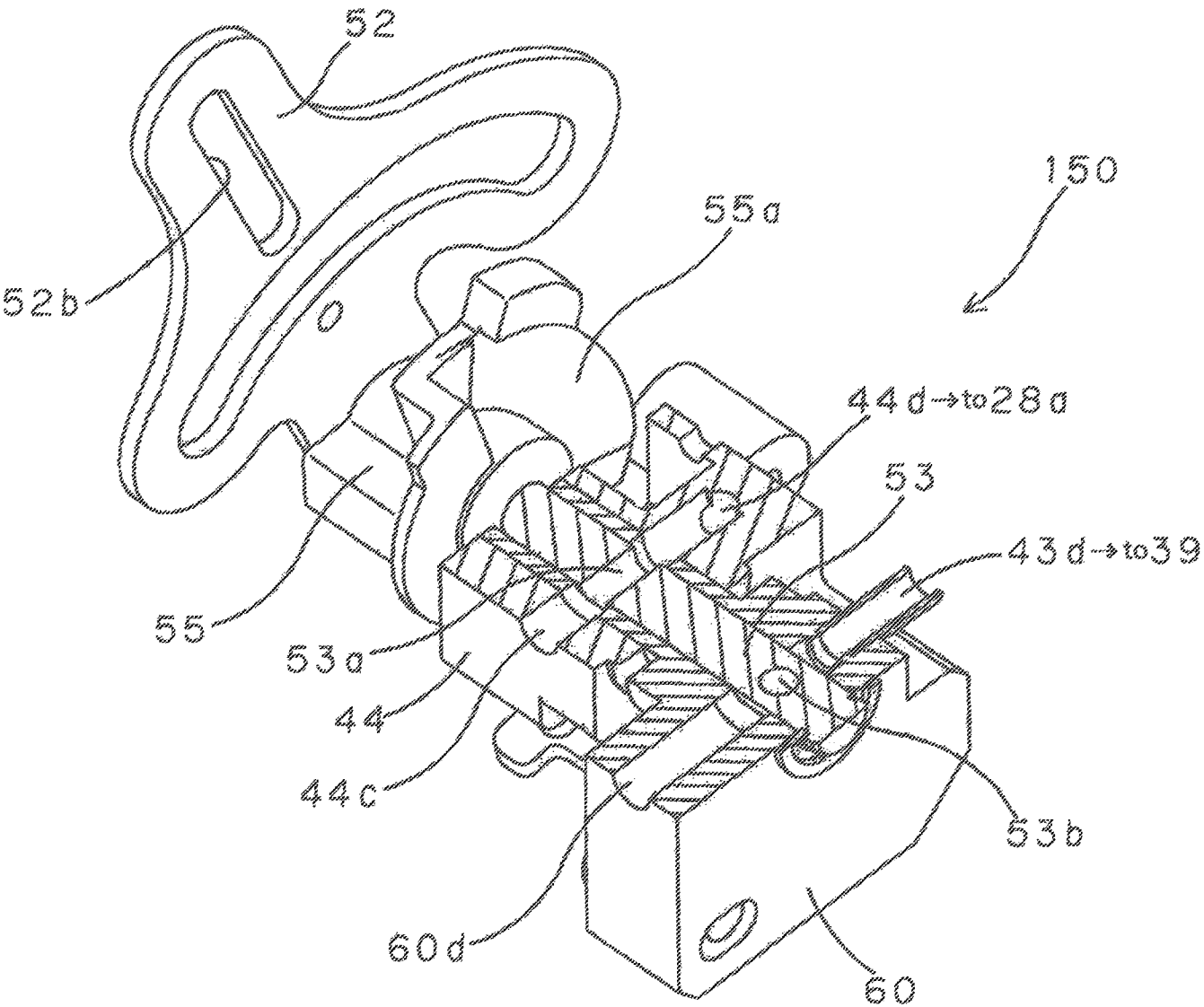
FIG. 12 (*a*) A perspective view for explaining the flow channel switching apparatus at the time of the looper threading in the needle threading device of sewing machine by the present invention.
Figure 12B:
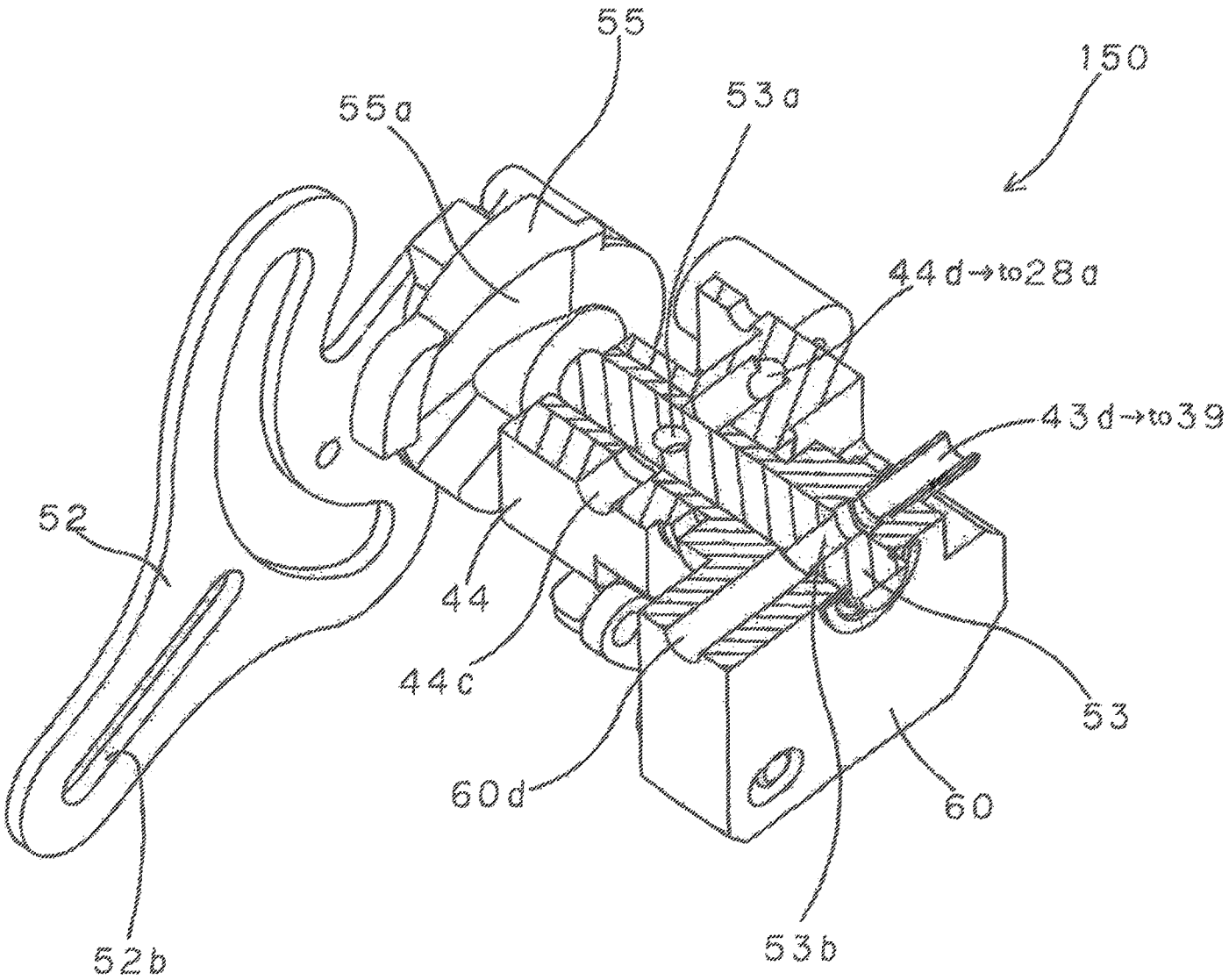

As shown in FIG. 2, FIG. 8, FIG. 12 (*a*), FIG. 12 (*b*) and FIG. 13, in the threading apparatus 20 of the sewing machine of the present invention, between the needle thread suction flow channel 44*d* and the looper thread connecting conduit pipe 39 and between the suction port 28*a* and the exhaust port 28*b* of the pump, respectively, the flow channel switching apparatus 150 that a needle thread suction flow channel 44*d* is communicated with the suction port 28*a*, the looper thread connecting conduit pipe 39 is communicated with an atmosphere port 60*d* and the switching is performed at the time of the needle threading and the exhaust port 28*b* is communicated with the looper thread connecting conduit pipe 39, the suction port 28*a* is communicated with an atmosphere port 44*c* and the switching is performed at the time of the looper threading is provided.

In the threading apparatus 20 of the sewing machine of the present invention, the flow channel switching apparatus 150 interlocks with the operation of the manual lever 69, that is, primary manual operation, and in the flow channel switching valve 53, the flow channel control main bodies 44, 60 which are united have the atmosphere port (suction release hole) 44*c* and the suction release hole 60*c*. The flow channel switching valve 53 is fitted into a shaft guide pipe 60*g* from the suction and exhaust release shaft through-hole 60*a*, and the atmosphere port (suction release hole) 44*c* and the suction release hole 60*c* are arranged in a same position. The flow channel switching valve 53 has suction and exhaust release holes 53*a*, 53*b*, and is connected to the atmosphere ports 44*c*, 60*d* depending on that rotation. The suction and exhaust release holes 53*a*, 53*b* are arranged apart in axial direction and arranged with the shift of 90 degrees in the rotation direction, and respectively communicate with the atmosphere ports 44*c*, 60*d* of the flow channel control main body 44 depending on the rotation of the inclination cam body 55 by the descending operation of the manual operation lever 69 of the position switching mechanism 26, therefore, depending on the rotation of the 90 degrees of the flow channel switching valve 53.

As shown in FIG. 2, the threading apparatus 20 of the sewing machine of the present invention is controlled by a control apparatus (CPU). That is, a needle threading button 133, a looper threading button 152, a foot controller 153 and a power switch 154 are connected to the control apparatus (CPU). The sewing machine motor M1 and the pump motor M2 are driven and controlled by the control apparatus (CPU).

In above embodiment, although the sewing machine which uses the hemstitch needle 1 (1*a*, 1*b*) and the double chain stitch needle 1 (1*e*, 1*f*, 1*g*) and the looper 2 (2*a*, 2*b*, 2*c*) as the loop capturing apparatus is explained, the present invention is similarly applicable to the sewing machine using the needle and the hook as the loop capturing apparatus.

In the threading apparatus 20 of the sewing machine of the present invention which is composed in this way, the operation and the actuation are performed as mentioned below.

Currently, when the sewing machine in the present invention is not actuated by the sewing machine motor M1, and further when the hermetic lip 7 (7*a*, 7*b*, 7*c*, 7*d*, 7*e*) is above evacuation position, in the position switching mechanism 26 of the threading apparatus 20 of the sewing machine, when the manual operation lever 69 as the primary manual operation of the operation part 30 slides on the threading set lever shaft 72 with the transmission part 38 and is operated downward, the stopper release shaft 81 slides on the straight cam 69*e* from the lower inclination cam 69*a* and rotates the stopper 80 counterclockwise, and further slides on the upper inclination cam 69*b* and rotates the stopper 80 clockwise, and the hook part 74*d* of the transmission part 38 is locked at a hook part 80*a* of the stopper 80 (FIG. 6). This state is the preparatory position of the hermetic lip 7 (7*a*, 7*b*, 7*c*, 7*d*, 7*e*).

Simultaneously, by the descending operation of the manual operation lever 69, the receiving part 77 which is supported rotatably to the threading set lever arm lid 75 by the receiving setscrew 78 rotates clockwise the threading lever connecting groove 52*b* of the inclination cam actuation arm plate 52 in the needle threading positioning part 32 (FIG. 8). For this reason, because the inclination cam body 55 rotates, the flow channel switching valve 53 also rotates 90 degrees. From this result, by the flow channel switching valve 53 of the flow channel switching apparatus 150, the needle thread suction flow channel 44*d* is communicated with the suction port 28*a*, the looper thread connecting conduit pipe 39 is communicated with the atmosphere port 60*d* and the switching is performed, thereby, the needle threading state of the hemstitch noodle 1 (1*a*, 1*b*) and the double chain stitch needle 1 (1*e*, 1*f*, 1*g*) becomes possible (FIG. 8, FIG. 12 (*b*)). In other words, the needle threading is given priority compared with the looper threading by the descending operation of the manual operation lever 69. the operation and the actuation of the looper threading is explained below.

Besides, when the manual operation lever 69 is operated downward, the lip drive pin 96 of the control part 90 rotates the control plate 50 clockwise in the lip drive pin connecting groove 50*b* of the control plate 50, and the above-mentioned inclination cam body 55 rotates, and one end of the control pin 45 touches the inclination cam body 55 through the actuation spring 47 and the cam follower connecting shaft 46 and another end touches the disc 42 through a control pin through-hole 44*a* of the flow channel control main body 44, the large diameter hole 50*c* of the control plate 50, the spring 49, the needle threading attaching plate 41 and the control pin through-hole 60*b* of the flow channel control main body 60 (FIG. 7, FIG. 8).

Here, when performing manual rotation operation of the hand pulley HP which is fixed to the lower shaft LS which is the drive shaft, that is, when performing the secondary manual operation, the control pin 45 is fitted into the notched part 42*b* and is shifted to the axial direction, and the threading position small diameter part 45*c* is fitted into a pin small diameter fitting hole 50*d*, thereby, the control plate 50 swings clockwise. Therefore, because the control part 90 descends, the hermetic lip 7 (7*a*, 7*b*, 7*c*, 7*d*, 7*e*) which is connected to this through the lip drive arm 100, the lip guide arm 103, lip holder shaft 117 and the lip holder 110 descends along the cam 91*a* of the lip guide plate 91 and the deformation cam 91*b*. In this way, in the needle threading positioning part 32, the hermetic lip 7 (7*a*, 7*b*, 7*c*, 7*d*, 7*e*) moves to the threading position and touches the hemstitch needle 1 (1*a*, 1*b*) and the double chain stitch needle 1 (1*e*, 1*f*, 1*g*).

Before actual threading, either group is selected by operating the flow channel selection lever 132 of the flow channel selection apparatus 33 which is used for reducing the size and the capacity of the pump PU. When swinging the flow channel selection lever 132 shown in FIG. 10 (*a*) to right direction, it is connected to the flow channel selection pipe 64 by the link 61, and the swinging motion of the flow channel selection lever 132 is changed to the linear motion of the link 61 and to the rotary motion of the flow channel selection pipe 64, and the suction entrance hole for hemstitch needle 64*b* is connected to the suction entrance hole for hemstitch needle 43*b*, and the flow channel of the hemstitch needle 1 (1*a*, 1*b*) is selected (FIG. 10 (*b*)). When swinging the flow channel selection lever 132 to left direction, the suction entrance hole for double chain stitch needle 64*c* is connected to the suction entrance hole for double chain stitch needle 43*c*, and the flow channel of the double chain stitch needle 1 (1*e*, 1*f*, 1*g*) is selected.

After completion of the touch to the hemstitch needle 1 (1*a*, 1*b*) and the double chain stitch needle 1 (1*e*, 1*f*, 1*g*) of such hermetic lip 7 (7*a*, 7*b*, 7*c*, 7*d*, 7*e*), the switch of the flow channel and the selection of the flow channel, when the power switch 154 is turned on and the needle threading button 133 is pressed, because the control apparatus (CPU) drives the threading pump PU by the pump motor M2, an operator brings one end of the needle thread 3*a* (3*b*, 3*c*, 3*d*, 3*e*) close to the thread entrance 5*f* in the needle eye 1*c*, 1*d*, 1*h*, 1*i*, 1*j* of the hemstitch needle 1 (1*a*, 1*b*) or the double chain stitch needle 1 (1*e*, 1*f*, 1*g*). When the hermetic lip 7 (7*a*, 7*b*, 7*c*, 7*d*, 7*e*) touches the hemstitch needle 1 (1*a*, 1*b*) and the double chain stitch needle 1 (1*e*, 1*f*, 1*g*), in upper part of the peripheral band-ring-shaped region 22 and the peripheral band-ring-shaped pad 24, the upper convex semicircular edge part segment 9*a* of the peripheral band-ring-shaped region 22 closely touches the upper flat shape band segment 9*e* which extends horizontally, and in lower part of the peripheral band-ring-shaped region 22 and the peripheral band-ring-shaped pad 24, the lower convex semicircular edge part segment 9*b* of the peripheral band-ring-shaped region 22 closely touches the lower semicircular band segment 9*f* of the peripheral band-ring-shaped pad 24, and in both lateral parts of the peripheral band-ring-shaped region 22 and the peripheral band-ring-shaped pad 24, two lateral band region parts 9*c* and 9*d* of the peripheral band-ring-shaped region 22 closely touch two lateral band segments 9*g* and 9*h* of the peripheral band-ring-shaped pad 24 respectively. Therefore, when the hermetic lip 7 (7*a*, 7*b*, 7*c*, 7*d*, 7*e*) touches the hemstitch needle 1 (1*a*, 1*b*) and the double chain stitch needle 1 (1*e*, 1*f*, 1*g*), the peripheral band-ring-shaped region 22 of the hemstitch needle 1 (1*a*, 1*b*) and the double chain stitch needle 1 (1*e*, 1*f*, 1*g*) closely touches the peripheral band-ring-shaped pad 24 of the hermetic lip 7 (7*a*, 7*b*, 7*c*, 7*d*, 7*e*). Therefore, when performing the needle threading pneumatically, because the suction can be performed from only the needle eye of the sewing machine needle, the threading of the needle thread can be performed certainly and stably.

In this case, the needle thread 3*a* (3*b*, 3*c*, 3*d*, 3*e*) which is carried by the suction from the needle thread suction conduit pipe 40*a*-40*e* collides against the thread stopping wall 116 of the separator 120 in the threading apparatus 20 which is provided between the needle thread suction conduit pipe 40*a*-40*e* and the pump PU, and in the space 115*g*, the flow velocity of air which collides against the thread stopping wall 116 is lower than the flow velocity which is carried by the suction toward the pump PU, and the suction toward the pump PU of the needle thread 3*a* (3*b*, 3*c*, 3*d*, 3*e*) which is stopped by the collision against the thread stopping wall 116 is prevented. The needle thread 3*a* (3*b*, 3*c*, 3*d*, 3*e*) which is carried by the suction and has the large inertial force becomes lower than the flow velocity which is carried by the suction toward the pump PU in the flow velocity of air which collides against the thread stopping wall 116, in other words, the needle thread 3*a* (3*b*, 3*c*, 3*d*, 3*e*) collides against the thread stopping wall 116 of the separated space 115*g*, and is stopped and is left behind, and here, the needle thread and the air are separated. On the other hand, in the space 115*h*, the air of small inertial force turns suddenly toward the flow channel which connects to the pump PU, and the space 115*h* becomes the flow channel of the sucked air, and is sucked from the suction port 28*a* through the flow channels 115*i*, 115*j* and the needle thread suction flow channel 44*d* by the pump PU.

Adversely, the hermetic lip 7 (7*a*, 7*b*, 7*c*, 7*d*, 7*e*) returns to a standby position by ascending operation of the manual operation lever 69 of the operation part 30. That is, the receiving part 77 which is supported rotatably to the threading set lever arm lid 75 by the receiving setscrew 78 rotates counterclockwise the threading lever connecting groove 52*b* of the inclination cam actuation arm plate 52 in the needle threading positioning part 32. For this reason, because the inclination cam body 55 rotates, the flow channel switching valve 53 also rotates 90 degrees. From this result, by the flow channel switching valve 53 of the flow channel switching apparatus 150, at the time of the looper threading, the exhaust port 28*b* is communicated with the looper thread connecting conduit pipe 39, the suction port 28*a* is communicated with the atmosphere port 44*c* and the switching is performed, thereby, the looper threading state of the looper 2 (2*a*, 2*b*, 2*c*) becomes possible (FIG. 8, FIG. 12 (*a*)).

In this case, when performing the primary manual operation by the operation part 141 of the looper threading positioning part 142, in the state that the looper thread guide conduit pipe 37 of the conduit pipe connecting mechanism 140 is connected to the looper thread connecting conduit pipe 39 in the nested state, the positioning pin 147 touches the disc 143, and the preparatory position which becomes the preparatory state of the looper threading is formed and held. Next, in the looper threading positioning part 142, when performing the manual rotation operation of the hand pulley HP, that is, when performing the secondary manual operation, if the positioning pin 147 fits into the notched part 144 by the conduit pipe connecting mechanism 140, the positioning pin 147 shifts to the axial direction, and the plate 145 slides, and the looper threading position which becomes the looper threading state of the looper threading is formed with predetermined looper threading timing from the preparatory position so that the looper thread connecting conduit pipe 39 is aligned to the looper hole entrance 2*g*, 2*h*, 2*i* of the looper 2 (2*a*, 2*b*, 2*c*) and touched, and the looper thread connecting conduit pipe 39 is touched to the looper hole entrance 2*g*, 2*h*, 2*i*, and the looper hole 2*d*, 2*e*, 2*f* is connected to the looper thread introduction entrance 35.

Here, when the looper threading button 152 is pressed, because the control apparatus (CPU) drives the threading pump PU by the pump motor M2, when the operator inserts one end of the looper thread 3*f*, 3*g*, 3*h* to the looper thread introduction entrance 35 of a looper thread introduction mechanism 161, that looper thread is carried to the looper hole 2*d*, 2*e*, 2*f* by air through the looper thread guide conduit pipe 37 from the looper thread connecting conduit pipe 39 of the conduit pipe connecting mechanism 140. In this way, in the looper 2 (2*a*, 2*b*, 2*c*), the looper threading to the looper hole 2*d*, 2*e*, 2*f* from the exhaust port 28*b* of the pump PU is performed by the compressed air.

Then, if reverse operation of the primary manual operation of the above-mentioned operation part 141 is performed, at the time of the stitch forming, the return to the stitch forming state which separates the looper thread connecting conduit pipe 39 from the looper hole entrance 2*g*, 2*h*, 2*i* of the looper 2 (2*a*, 2*b*, 2*c*) is performed.

After completion of such looper threading, because the control apparatus (CPU) drives the needle bar drive mechanism 12*c*, the feed mechanism 15 and the looper drive mechanism 160 from the upper and lower shafts US, LS by the sewing machine motor M1 by stepping on the foot controller 153, the stitch forming of the hemstitch (overlock) on the cloth WP which should be sewn is performed by crossing the needle thread 3*a*, 3*b* which is inserted to the needle eye 1*c*, 1*d* of the hemstitch needle 1 (1*a*, 1*b*) which vertically moves by piercing the throat plate 13, the lower looper thread 3*f* which is inserted to the looper hole 2*d* of the lower looper 2*a* which reciprocates while drawing an arc-like trajectory so as to cross the trajectory of the hemstitch needle 1 (1*a*, 1*b*) at the underside of the throat plate 13 and the upper looper thread 3*g* which is inserted to the looper hole 2*e* of the upper looper 2*b* which reciprocates while drawing the elliptical trajectory so as to cross the trajectory of the lower looper 2*a* at the lateral side of the throat plate 13 and so as to cross the trajectory of the hemstitch needle 1 (1*a*, 1*b*) at the upper side of the throat plate 13, and the stitch forming of the double chain stitch (cover stitch) on the cloth WP which should be sewn is performed by crossing the needle thread 3*c*, 3*d*, 3*e* which is inserted to the needle eye 1*h*, 1*i*, 1*j* of the double chain stitch needle 1 (1*e*, 1*f*, 1*g*) and the double chain stitch looper thread 3*h* which is inserted to the looper hole 2*f* of the double chain stitch looper 2*c* which reciprocates while drawing the elliptical trajectory so as to cross the trajectory of the double chain stitch needle 1 (1*e*, 1*f*, 1*g*).

INDUSTRIAL APPLICABILITY

By only one pump which is driven by the sewing machine motor, the threading device of sewing machine in the present invention can be applied suitably to the sewing machine such as the lock stitch sewing machine, the serger, the double chain stitch sewing machine, or the cover stitch sewing machine which use the suction and the exhaust to the gas carrying, performs the needle threading pneumatically from the needle eye of the sewing machine needle with the suction form and performs the looper threading pneumatically to the looper hole of the sewing machine looper with the exhaust form.

EXPLANATION OF THE NUMERALS

LS lower shaft
US upper shaft
LP lower shaft pulley
TV timing belt
UP upper shaft pulley
HP hand pulley
M1 sewing machine motor
M2 pump motor
CPU control apparatus
WP cloth
ST needle blade
PU pump
V belt
PP pulley
t distance
1, (1*a*, 1*b*) hemstitch needle
1*c*, 1*d*, 1*h*, 1*i*, 1*j* needle eye
1 (1*e*, 1*f*, 1*g*) double chain stitch needle
1*k* concave part
2 (2*a*, 2*b*, 2*c*) looper
2*d*, 2*e*, 2*f* looper hole
2*g*, 2*h*, 2*i* looper hole entrance
3*a*, 3*b*, 3*c*, 3*d*, 3*e* needle thread
3*f*, 3*g*, 3*h* looper thread
4 stitch forming apparatus
5 (5*a*, 5*b*, 5*c*, 5*d*, 5*e*) thread exit
5*f* thread entrance
6 (6*a*, 6*b*, 6*c*, 6*d*, 6*e*) suction port hole
7 (7*a*, 7*b*, 7*c*, 7*d*, 7*e*) hermetic lip
9*a* upper flat shape band region part
9*b* lower semicircular band region part
9*c*, 9*d* lateral band region part
9*e* upper flat shape band segment
9*f* lower semicircular band segment
9*g*, 9*h* lateral band segment
9*j*, 9*k* wing
10 needle bar
11 presser bar
12*a* needle bar-presser bar unit base
12*b* needle clamp
12C needle bar drive mechanism
13 throat plate
14 presser foot
15 feed mechanism
20 pneumatic threading apparatus
22 peripheral band-ring-shaped region
24 peripheral band-ring-shaped pad

26 position switching mechanism
28*a* suction port
28*b* exhaust port
30 operation part
32 needle threading positioning part
33 flow channel selection apparatus
35 looper thread introduction entrance
37 looper thread guide conduit pipe
38 transmission part
39 looper thread connecting conduit pipe
40*a*-40*e* needle thread suction conduit pipe
41*a*, 41*b* grouped needle thread suction conduit pipe
41 needle threading attaching plate
42 disc
42*a* end face
42*b* notched part
43*a* suction exit hole
43*b* suction entrance hole for hemstitch needle
43*c* suction entrance hole for double chain stitch needle
43*d* exhaust hole
44 flow channel control main body
44*a* control pin through-hole
44*b* valve through-hole
44*c* atmosphere port
44*d* needle thread suction flow channel
45 control pin
45*a* pin end
45*b* preparatory position large diameter part
45*c* threading position small diameter part
45*d* long hole
45*e* housing hole
46 cam follower connecting shaft
47 actuation spring
49 spring
48 pin
50 control plate
50*a* valve through-hole
50*b* lip drive pin connecting groove
50*c* pin fitting large diameter hole
52 inclination cam actuation arm plate
52*a* cam body attaching hole
52*b* threading lever connecting groove
52*c* attaching hole
53 flow channel switching valve
53*a*, 53*b* suction and exhaust release hole
54 suction and exhaust release shaft pin
55 inclination cam body
55*a* inclination cam
55*b* suction and exhaust release shaft connecting hole
56 screw
60 flow channel control main body
60*a* suction and exhaust release shaft through-hole
60*b* control pin through-hole
60*c* suction release hole
60*d* atmosphere port
60*g* shaft guide pipe
61 flow channel selection link
64 flow channel selection pipe
64*a* suction exit hole
64*b* suction entrance hole for hemstitch needle
64*c* suction entrance hole for double chain stitch needle
65 flow channel selection arm
69 manual lever
69*a* lower inclination cam
69*b* upper inclination cam
69*c* long groove
69*d* long groove
69*e* straight cam
71 threading set lever plate
71*a* lip guide plate attaching surface
71*b* threading set lever shaft attaching hole
71*c* manual lever sliding surface
71*d* stopper release shaft clearance hole
71*e* spring stud
71*j* slit
72 threading set layer shaft
74*a* spring attaching arm
74*b* threading set lever shaft sliding hole
74*c* attaching part
74*d* hook part
74*e* pad
75 threading set lever arm lid
76 setscrew
77 receiving part
78 receiving setscrew
79*a*, 79*b* screw
79*c* pipe
80 stopper
80*a* hook part
81 stopper release shaft
82 stopper shaft
83 stopper spring
84 setscrew
85 washer
86 lip drive spring
87 spacer
88 screw
89 lip return spring
89*a* spacer
89*b* screw
90 control part
90*a* lip drive guide shaft attaching hole
90*b* pad
90*d* attaching hole
90*f* attaching hole
91 lip guide plate
91*a* cam
91*b* deformation cam
91*f*, 91*g* lip drive guide shaft attaching hole
93 lip drive guide shaft
96 lip drive pin
98 pin
99 positioning pin
100 lip drive arm
100*a* swing hole
100*b* pin hole
103 lip guide arm
110 lip holder
115 separator main body
115*a* screw
115*b* grouped suction port
115*c* grouped suction port
115*g* space
115*h* space
115*i*, 115*j* flow channel
116 thread stopping wall
117 lip holder shaft
120 separator
131 flow channel selection lever base
131*a* pivot
131*b* stopper
132 flow channel selection lever
132*a* flow channel selection arm
133 needle threading button

135*a* suction valve
135*b* exhaust valve
135*c* eccentric cam
135*d* drive rod
135*e* swing link
135*f* piston
136 looper threading lever
140 conduit pipe connecting mechanism
141 operation part
142 looper threading positioning part
143 disc
144 notched part
145 support plate
146 spring
147 positioning pin
150 flow channel switching apparatus
152 looper threading button
153 foot controller
154 power switch
160 looper drive mechanism

The invention claimed is:

1. A pneumatic threading device of a sewing machine having a stitch forming apparatus including a needle of the sewing machine and a loop capturing apparatus forming stitches by entangling a needle thread being threaded to a needle eye of said needle by cooperating with said needle and threading to the needle eye of said needle pneumatically, comprising:

a hermetic lip being hermetically touchable to a peripheral band-ring-shaped region of said needle surrounding a thread exit of the needle eye of said needle and having a corresponding peripheral band-ring-shaped pad surrounding a suction port hole sucking from the thread exit of the needle eye of said needle, a needle thread suction conduit pipe being connected to said suction port hole of said hermetic lip, a position switching mechanism moving said hermetic lip to a threading position so that said suction port hole is aligned to the thread exit of the needle eye of said needle and is touched to said needle at the time of the needle threading and moving to a standby position by retreating said hermetic lip from said needle at the time of the stitch forming, and a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, wherein:

said needle has a concave part for passing a loop-taker point of said loop capturing apparatus in an upper part of said needle eye and a peripheral band-ring-shaped region of said needle has an upper flat shape band region part intersecting an intermediate part of said concave part and extending horizontally, a lower semicircular band region part intersecting a lower part of said needle eye and extending horizontally and two lateral band region parts connecting said upper flat shape band region part and said lower semicircular band region part and extending vertically and in a circumferential direction, and corresponding to this, the peripheral band-ring-shaped pad of said hermetic lip has an upper flat shape band segment extending horizontally, a lower semicircular band segment extending horizontally and two lateral band segments connecting said upper flat shape band segment and said lower semicircular band segment and extending vertically and in a circumferential direction.

2. A pneumatic threading device of a sewing machine according to claim 1, wherein:

said hermetic lip is formed by one material selected from flexible rubbers, plastics and corks.

3. A pneumatic threading device of a sewing machine according to claim 1, wherein:

said hermetic lip is formed by one material selected from elastic rubbers, plastics and corks which do not impair said flexibility.

4. A pneumatic threading device of a sewing machine having a stitch forming apparatus including a needle of the sewing machine and a loop capturing apparatus forming stitches by entangling a needle thread being threaded to a needle eye of said needle by cooperating with said needle and threading to the needle eye of said needle pneumatically, comprising:

a hermetic lip being hermetically touchable to a peripheral band-ring-shaped region of said needle surrounding a thread exit of the needle eye of said needle and having a corresponding peripheral band-ring-shaped pad surrounding a suction port hole sucking from the thread exit of the needle eye of said needle, a needle thread suction conduit pipe being connected to said suction port hole of said hermetic lip, a position switching mechanism moving said hermetic lip to a threading position so that said suction port hole is aligned to the thread exit of the needle eye of said needle and is touched to said needle at the time of the needle threading and moving to a standby position by retreating said hermetic lip from said needle at the time of the stitch forming, and a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, wherein:

a separator having a thread stopping wall that said needle thread being carried by the suction from said needle thread suction conduit pipe collides and a space preventing that flow velocity of air colliding against said thread stopping wall is lower than flow velocity being carried by the suction toward said pump and said needle thread being stopped by the collision against said thread stopping wall is sucked toward said pump is provided between said needle thread suction conduit pipe and said pump.

5. A pneumatic threading device of a sewing machine having a stitch forming apparatus including a needle of the sewing machine and a loop capturing apparatus forming stitches by entangling a needle thread being threaded to a needle eye of said needle by cooperating with said needle and threading to the needle eye of said needle pneumatically, comprising:

a hermetic lip being hermetically touchable to a peripheral band-ring-shaped region of said needle surrounding a thread exit of the needle eye of said needle and having a corresponding peripheral band-ring-shaped pad surrounding a suction port hole sucking from the thread exit of the needle eye of said needle, a needle thread suction conduit pipe being connected to said suction port hole of said hermetic lip, a position switching mechanism moving said hermetic lip to a threading position so that said suction port hole is aligned to the thread exit of the needle eye of said needle and is touched to said needle at the time of the needle threading and moving to a standby position by retreating said hermetic lip from said needle at the time of the stitch forming, and a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, wherein:

said position switching mechanism has an operation part forming a preparatory position becoming a preparatory state of said needle threading by primary manual operation and holding said preparatory position and a needle threading positioning part being moved with said operation part and forming a needle threading position becoming a needle threading state of said needle threading from said preparatory position with predetermined needle threading timing depending on secondary manual operation.

6. A pneumatic threading device of a sewing machine according to claim 5, wherein:

said operation part has a manual lever being operated manually and a transmission part being connected to said manual lever and holding said preparatory position by a hook, and said needle threading positioning part has a control part being movable through said transmission part, and being repelled elastically by a spring, and forming the needle threading position becoming the needle threading state of said needle threading with predetermined needle threading timing depending on said secondary manual operation and moving said hermetic lip so that said suction port hole is aligned to the thread exit of the needle eye of said needle and touching said needle.

7. A pneumatic threading device of a sewing machine according to claim 6, wherein:

said needle threading positioning part has a control pin, a control plate regulating a movement of said control pin and a positioning pin piercing said control plate and touching a disc having a notched part being driven by synchronizing to said needle and shifting to an axial direction when fitting into said notched part depending on said secondary manual operation and swinging said control plate and moving said hermetic lip by said control part so that said suction port hole is aligned to the thread exit of the needle eye of said needle and touching said needle.

8. A pneumatic threading device of a sewing machine according to claim 6, wherein:

said needle is composed with multiple needles, and said multiple needles are divided into at least two groups, and a flow channel selection apparatus selecting each said needle of two groups and connecting to said suction port of said pump is provided.

9. A pneumatic threading device of a sewing machine according to claim 8, wherein:

a flow channel switching apparatus that said needle thread suction conduit pipe is communicated with said suction port, said looper thread connecting conduit pipe is communicated with an atmosphere port and switching is performed at the time of the needle threading and said exhaust port is communicated with said looper thread connecting conduit pipe, said suction port is communicated with an atmosphere port and switching is performed at the time of the looper threading is provided.

10. A pneumatic threading device of a sewing machine having a stitch forming apparatus including a needle of the sewing machine and a loop capturing apparatus forming stitches by entangling a needle thread being threaded to a needle eye of said needle by cooperating with said needle and threading to the needle eye of said needle pneumatically, comprising:

a hermetic lip being hermetically touchable to a peripheral band-ring-shaped region of said needle surrounding a thread exit of the needle eye of said needle and having a corresponding peripheral band-ring-shaped pad surrounding a suction port hole sucking from the thread exit of the needle eye of said needle, a needle thread suction conduit pipe being connected to said suction port hole of said hermetic lip, a position switching mechanism moving said hermetic lip to a threading position so that said suction port hole is aligned to the thread exit of the needle eye of said needle and is touched to said needle at the time of the needle threading and moving to a standby position by retreating said hermetic lip from said needle at the time of the stitch forming, and a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, wherein:

the stitch forming apparatus forming the stitches by entangling the needle thread and the looper thread being threaded respectively to the needle eye of said needle and the looper hole of said looper by cooperating with the looper as said loop capturing apparatus is provided, and a looper thread introduction entrance that an exhaust port of said pump is connected, a looper thread guide conduit pipe being connected to said looper thread introduction entrance and carrying one end of said looper thread being inserted to said looper thread introduction entrance by compressed air from said exhaust port, a looper thread connecting conduit pipe being fitted into said looper thread guide conduit pipe in the nested state and touching the looper hole entrance of said looper at the time of the looper threading, and a conduit pipe connecting mechanism making said looper thread connecting conduit pipe touch the looper hole entrance of said looper and performing the looper threading to the looper hole of said looper through said looper thread connecting conduit pipe via said looper thread guide conduit pipe from said looper thread introduction entrance about one end of the looper thread being inserted to said looper thread introduction entrance at the time of the looper threading and separating said looper thread connecting conduit pipe from the looper hole entrance of said looper at the time of the stitch forming are provided.

11. A pneumatic threading device of a sewing machine according to claim 10, wherein:

said looper threading positioning part has a positioning pin being driven by synchronizing to said looper, touching a disc having a notched part, shifting to an axial direction when fitting into said notched part depending on said secondary manual operation, moving said control plate, and moving said looper thread connecting conduit pipe so as to align and touch to the looper hole entrance of said looper.

12. A pneumatic threading device of a sewing machine having a stitch forming apparatus including a needle of the sewing machine and a loop capturing apparatus forming stitches by entangling a needle thread being threaded to a needle eye of said needle by cooperating with said needle and threading to the needle eye of said needle pneumatically, comprising:

a hermetic lip being hermetically touchable to a peripheral band-ring-shaped region of said needle surrounding a thread exit of the needle eye of said needle and having a corresponding peripheral band-ring-shaped pad surrounding a suction port hole sucking from the thread exit of the needle eye of said needle, a needle thread suction conduit pipe being connected to said suction port hole of said hermetic lip, a position switching mechanism moving said hermetic lip to a threading position so that said suction port hole is aligned to the thread exit of the needle eye of said needle and is touched to said needle at the time of the needle threading and moving to a standby position by retreating said hermetic lip from said needle at the time of the stitch forming, and a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, wherein:

said conduit pipe connecting mechanism has an operation part being attached to a sewing machine bed, and forming a preparatory position becoming preparatory state of said looper threading by the primary manual operation and holding said preparatory position and a looper threading positioning part forming a looper threading position becoming looper threading state of said looper threading with predetermined looper threading timing depending on the secondary manual operation from said preparatory position.

13. A pneumatic threading device of a sewing machine according to claim 12, wherein:

said flow channel switching apparatus has a flow channel switching valve interlocking with said primary manual operation and that one of said suction port and said exhaust port is communicated with one of said needle thread suction conduit pipe and said looper thread connecting conduit pipe and the other of said suction port and said exhaust port is communicated with an atmosphere port, and the other of said suction port and said exhaust port is communicated with the other of said needle thread suction conduit pipe and said looper thread connecting conduit pipe and one of suction port and said exhaust port is communicated with an atmosphere port, and switching is performed.

14. A pneumatic threading device of a sewing machine having a stitch forming apparatus including a needle of the sewing machine and a loop capturing apparatus forming locked stitches by entangling a needle thread being threaded to a needle eye of said needle by cooperating with said needle and threading to the needle eye of said needle pneumatically, comprising:

a hermetic lip being hermetically touchable to a convex semicircular edge part of said needle including a thread exit of the needle eye of said needle and having a corresponding concave semicircular edge part including a suction port hole sucking from the needle eye of said needle, a needle thread suction conduit pipe being connected to said suction port hole of said hermetic lip, a position switching mechanism making said hermetic lip touch said needle so that said suction port hole is aligned to the thread exit of the needle eye of said needle at the time of the needle threading and moving to a standby position by retreating said hermetic lip from said needle at the time of the stitch forming, a pump that said needle thread suction conduit pipe is connected to a suction port and performing the needle threading to the needle eye of said needle by sucking one end of the needle thread being inserted to a thread entrance of the needle eye of said needle to said suction port via said suction port hole from the thread exit of the needle eye of said needle through said needle thread suction conduit pipe at the time of the needle threading, a stitch forming apparatus forming chain stitches by entangling the needle thread and the looper thread being threaded respectively to the needle eye of said needle and the looper hole of said looper by cooperating with the looper as said loop capturing apparatus, a looper thread introduction entrance that an exhaust port of said pump is connected, a looper thread guide conduit pipe being connected to said looper thread introduction entrance and carrying one end of said looper thread being inserted to said looper thread introduction entrance by compressed air from said exhaust port, a looper thread connecting conduit pipe being fitted into said looper thread guide conduit pipe in the nested state and touching the looper hole entrance of said looper at the time of the looper threading, and a conduit pipe connecting mechanism making said looper thread connecting conduit pipe touch the looper hole entrance of said looper and performing the looper threading to the looper hole of said looper through said looper thread connecting conduit pipe via said looper thread guide conduit pipe from said looper thread introduction entrance about one end of the looper thread being inserted to said looper thread introduction entrance at the time of the looper threading and separating said looper thread connecting conduit pipe from the looper hole entrance of said looper at the time of the stitch forming.

* * * * *